US008086119B2

(12) United States Patent
Furukata et al.

(10) Patent No.: US 8,086,119 B2
(45) Date of Patent: Dec. 27, 2011

(54) FIXING DEVICE AND IMAGE FORMING DEVICE

(75) Inventors: Hiroko Furukata, Saitama (JP); Shigeru Watanabe, Saitama (JP); Kiichirou Arikawa, Saitama (JP); Yasutaka Gotoh, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 474 days.

(21) Appl. No.: 12/400,242

(22) Filed: Mar. 9, 2009

(65) Prior Publication Data

US 2009/0226227 A1 Sep. 10, 2009

(30) Foreign Application Priority Data

Mar. 10, 2008 (JP) ..... P2008-059727

(51) Int. Cl.
*G03G 15/20* (2006.01)

(52) U.S. Cl. ..... 399/33

(58) Field of Classification Search ..... 399/33, 399/67, 320, 328, 331, 332, 339
See application file for complete search history.

(56) References Cited

U.S. PATENT DOCUMENTS

| | | | | |
|---|---|---|---|---|
| 7,079,789 | B2 * | 7/2006 | Wang | 399/122 |
| 7,764,913 | B2 * | 7/2010 | Tsunoda | 399/329 |
| 2007/0019977 | A1 | 1/2007 | Sawamura et al. | |

FOREIGN PATENT DOCUMENTS

| | | |
|---|---|---|
| JP | 06-348192 | 12/1994 |
| JP | 2004-109521 | 4/2004 |
| JP | 2007-025571 | 2/2007 |

* cited by examiner

*Primary Examiner* — David Gray
*Assistant Examiner* — Frederick Wenderoth
(74) *Attorney, Agent, or Firm* — Morgan, Lewis & Bockius LLP

(57) ABSTRACT

A fixing device includes a heating rotating body that is heated by a heater and rotates, a pressurizing rotating body that is in contact with a surface portion of the heating rotating body and rotates, and that forms a fixing portion, a pressing mechanism that presses the pressurizing rotating body against the heating rotating body and that uses a plurality of springs disposed on both end portions of the pressurizing rotating body in a direction of the second rotation shaft, and a switching mechanism that switches between a first pressing state in which first combination of springs selected from among the plurality of springs are maintained and a second pressing state in which second combination of springs selected from among the plurality of springs except the first combination of the springs are maintained.

13 Claims, 17 Drawing Sheets

FIXING DEVICE AND IMAGE FORMING DEVICE

CROSS-REFERENCE TO RELATED APPLICATION

This application is based on and claims priority under 35 USC 119 form Japanese Patent Application No. 2008-059727 filed Mar. 10, 2008.

BACKGROUND

1. Technical Field

The present invention relates to a fixing device and an image forming device.

2. Related Art

As image forming devices, such as printers and copiers, a device is available in which an unfixed image formed by development using developer is transferred onto a recording medium, such as paper, and the recording medium onto which the unfixed image is transferred is subjected to fixing using a fixing device to form images of characters, figures, patterns, photographic pictures, etc. In addition, as a fixing device for use in such an image forming device, a device configured as described below is available.

Such a fixing device is equipped with a heating rotating body having the shape of a roll or the like and rotating while being heated using a heater; and a pressurizing rotating body having the shape of a roll or belt or the like and rotating while making contact with the surface portion of the heating rotating body along the direction of the rotation shaft thereof so as to form a fixing portion through which a recording medium having an unfixed image is passed, wherein the recording medium having the unfixed image is introduced into and passed through the fixing portion formed between the heating rotating body and the pressurizing rotating body, thereby to heat and pressurize the unfixed image and to fix the unfixed image to the recording medium. The pressurizing rotating body is pressed against the heating rotating body using a pressing mechanism that generally utilizes the force of a compression spring or the like.

SUMMARY

According to an aspect of the invention, a fixing device includes a heating rotating body that is heated by a heater and rotates about a first rotation shaft, a pressurizing rotating body that is in contact with a surface portion of the heating rotating body extending along a direction of the first rotation shaft and rotates about a second rotation shaft, and that forms a fixing portion through which a recording medium carrying an unfixed image is passed, a pressing mechanism that presses the pressurizing rotating body against the heating rotating body and that uses a plurality of springs disposed on both end portions of the pressurizing rotating body in a direction of the second rotation shaft, and a switching mechanism that switches between a first pressing state in which first combination of springs selected from among the plurality of springs in the pressing mechanism are maintained so that a pressure of the first combination is exerted and a second pressing state in which second combination of springs selected from among the plurality of springs except the first combination of the springs are maintained so that a pressure of the second combination is exerted.

According to the aspect of the invention, the state due to the effect of the springs of the pressing mechanism for pressing the pressurizing rotating body against the heating rotating body may be changed easily, and fixing may be performed while preventing wrinkle generation on the recording medium during fixing, in comparison with the case not having the configuration thereof.

BRIEF DESCRIPTION OF THE DRAWINGS

Exemplary embodiments of the invention will be described in detail based on the following figures, wherein.

DETAILED DESCRIPTION

First Exemplary Embodiment

Figure 1:
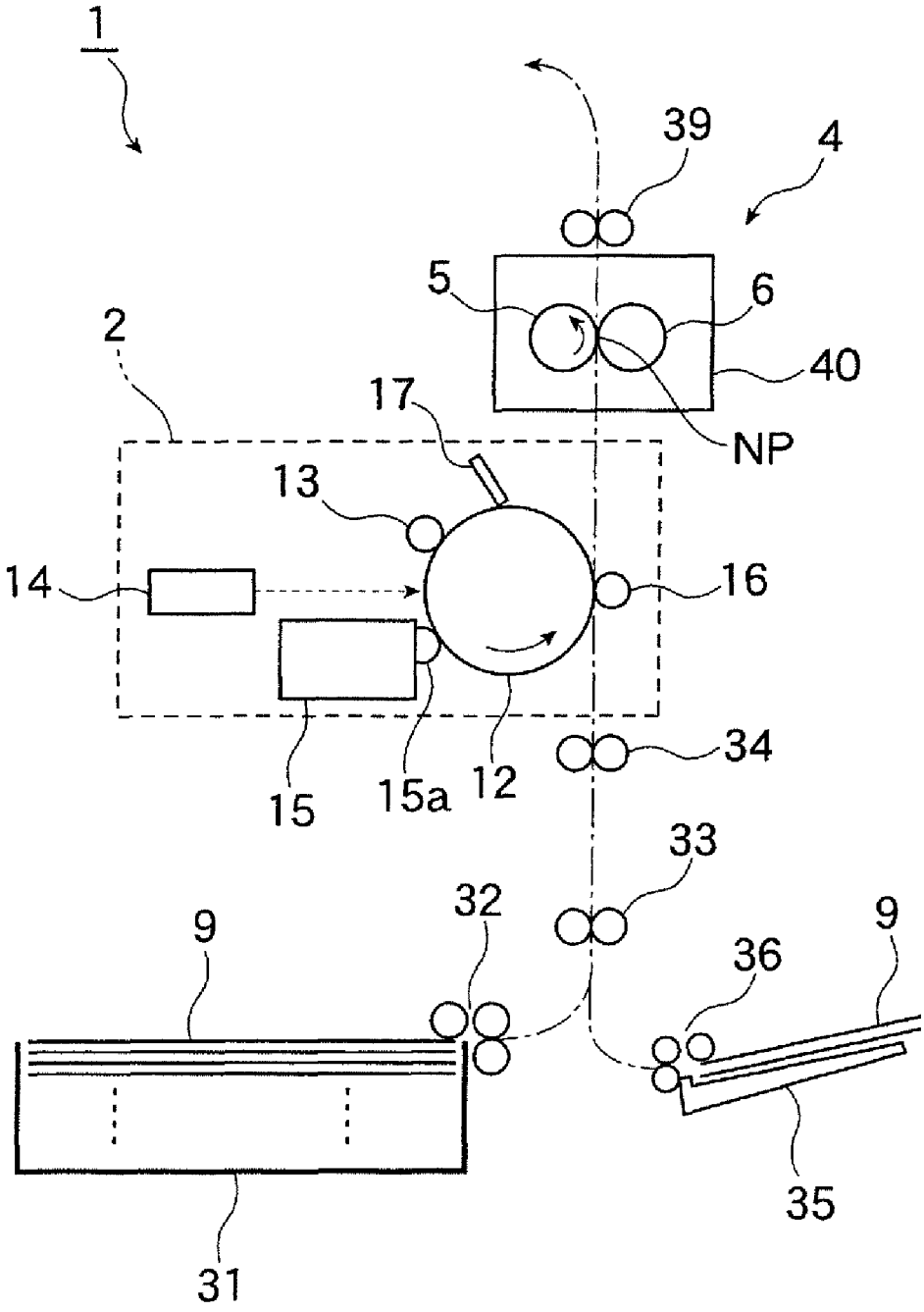
FIG. 1 is a schematic explanatory view showing an image forming device and a fixing device according to a first (second to fifth) exemplary embodiment.

FIG. 1 is a view showing an image forming device 1 (and a fixing device 4) according to a first exemplary embodiment of the present invention.

The image forming device 1 is mainly equipped with, inside its housing (not shown), an imaging device 2 for forming an unfixed toner image on the basis of image information and finally transferring the toner image to a recording medium 10, such as paper; a sheet feeding device 3 for accommodating the recording medium 10 and conveying and feeding the recording medium 10 to the imaging device 2; and a fixing device 4 for fixing the toner image transferred using the imaging device 2 on the recording medium 10. The arrow-pointed alternate long and short dashed line in the figure indicates the main conveying path of the recording medium 10.

The imaging device 2 is capable of forming a toner image and transferring the toner image using, for example, the known electrophotographic system. More specifically, the imaging device 2 is equipped with a photosensitive drum 12 that rotates in the direction indicated by an arrow. A charging device 13 for charging the surface (image retaining face) of the photosensitive drum 12; an exposing device 14 for irradiating light based on image information (signals) onto the charged surface of the photosensitive drum 12 to form an electrostatic latent image having a potential difference; a developing device 15 for developing the electrostatic latent image on the photosensitive drum 12 using toner serving as developer to form a toner image; a transferring device 16 for transferring the toner image onto the recording medium 10 fed from the sheet feeding device 3, and a cleaning device 17 for removing toner and the like remaining on the surface of the photosensitive drum 12 after the transfer to clean the surface are mainly disposed around the photosensitive drum 12.

For example, the photosensitive drum 12 is configured such that an image retaining face having a photoconductive layer (photosensitive layer) made of an organic photosensitive material is formed on a cylindrical substrate. As the charging device 13, a device conforming to the contact charging system is used in which charging is performed by applying a predetermined charging voltage to a charging roll that rotates while making contact with the surface of the photosensitive drum 12. As the exposing device 14, a device formed of an LED (light emitting diode) recording head, a semiconductor laser scanner, etc. is used. Image signals, obtained after image information input from an image reading device or a storage medium reading device installed in or connected (wired or wireless) to the image forming device 1 or from an external device for creating images, such as a computer, is subjected to predetermined processing using an image processing device (not shown), is input to the exposing device 14.

As the developing device 15, a device is used in which developer (one-component developer, two-component developer, etc.) containing predetermined color toner and being charged is supplied to the surface of the photosensitive drum 12 via the developing roll 15*a* to which a developing voltage is applied. As the transferring device 16, a device conforming to a contact system in which transfer is performed by applying a predetermined transfer voltage to a transferring roll that rotates while making contact with the surface of the photosensitive drum 12 is used.

The sheet feeding device 3 is mainly equipped with a cassette 31 for accommodating plural of pieces of the recording medium 10 having a predetermined size, etc. to be fed to the imaging device 2, in a stacked state; and a delivering device 32 for delivering and conveying the pieces of the recording medium 10 accommodated in this cassette 31, one by one. Plural of the cassettes 31 may be loaded as necessary. In addition, the sheet feeding device 3 is connected to a sheet feeding and conveying path formed of plural of conveying roll pairs 33, 34, conveying guides, etc. for conveying the recording medium 10 from the cassette 31 to the transfer portion (between the photosensitive drum 12 and the transferring device 16) of the imaging device 2. The sheet conveying roll pair 34 is configured as a conveying time adjusting roll pair that is driven to deliver the recording medium 10 when predetermined delivery timing is reached after the leading end of the recording medium 10 to be conveyed is temporarily stopped. A sheet conveying path is also provided, for example, between the imaging device 2 and the fixing device 4.

The fixing device 4 is equipped, inside its housing 40, with a roll-shaped heating rotating body 5 rotating in the direction indicated by the arrow in FIG. 1 while being heated using a heater so that the surface temperature thereof is maintained at a predetermined temperature; and a belt-shaped pressurizing rotating body 6 rotating while making contact with the surface portion of the heating rotating body 5 nearly along the direction of the rotation shaft thereof so as to form a pressure-contact portion (fixing portion) NP. Numeral 39 in FIG. 1 designates a discharging roll pair for discharging the recording medium 10 from the fixing device 4 after fixing. The fixing device 4 will be described later in detail.

The image forming device 1 configured as described above operates as described below during image formation.

First, in the imaging device 2, the photosensitive drum 12 begins to rotate, the surface of the rotating photosensitive drum 12 is charged to a predetermined charged potential using the charging device 13, and light based on image signals is irradiated from the exposing device 14 to the surface of the charged photosensitive drum 12, whereby an electrostatic latent image having a predetermined image potential is formed. Then, when the electrostatic latent image is moved by the rotation of the photosensitive drum 12 and passes through the developing device 15, toner supplied from the developing roll 15*a* of the developing device 15 attaches electrostatically to the latent image portion, whereby the latent image portion is developed as a toner image. After the development, the toner image on the photosensitive drum 12 is transferred electrostatically to the recording medium 10, which is delivered and conveyed from the sheet feeding device 3, at the transfer position opposed to the transferring device 16. After the transfer of the toner image is completed, the surface of the photosensitive drum 12 is cleaned using the cleaning device 17.

Next, the recording medium 10 on which the unfixed toner image has been formed using the imaging device 2 is conveyed to the fixing device 4, and introduced into the pressure-contact portion NP between the heating rotating body 5 and the pressurizing rotating body 6. Hence, in the fixing device 4, the recording medium 10 is conveyed and passed through while being held at the pressure-contact portion NP. At this time, the unfixed toner image is heated and pressurized, thereby being fixed to the recording medium 10. After the fixing, the recording medium 10 is discharged from the fixing device 4 and then conveyed using the discharging roll pair 39 and the like to a discharging accommodating portion (not shown).

As such recording media 10 on which images are formed, in addition to sheet-shaped recording media, such as paper, thick paper, transparent sheets and postcards, envelope-shaped recording media having a form of flat container typified by an envelope may also be used in the image forming device 1. Such envelope-shaped recording media 10 are accommodated in the cassette 31 of the sheet feeding device 3 and conveyed to the transfer position of the imaging device 2 via the sheet feeding and conveying path during image formation, or accommodated in a manual feeding tray 35 as shown in FIG. 1, merged with the sheet feeding and conveying path using a delivering device 36 and conveyed to the transfer position of the imaging device 2 during image formation. Furthermore, the fixing device 4, etc. in the image forming device 1 is provided with a configuration described later so that favorable fixing may be performed without generating wrinkles when image formation is performed using such envelope-shaped recording media as the recording media 10.

Next, the fixing device 4 will be described below in detail.

Figure 2:
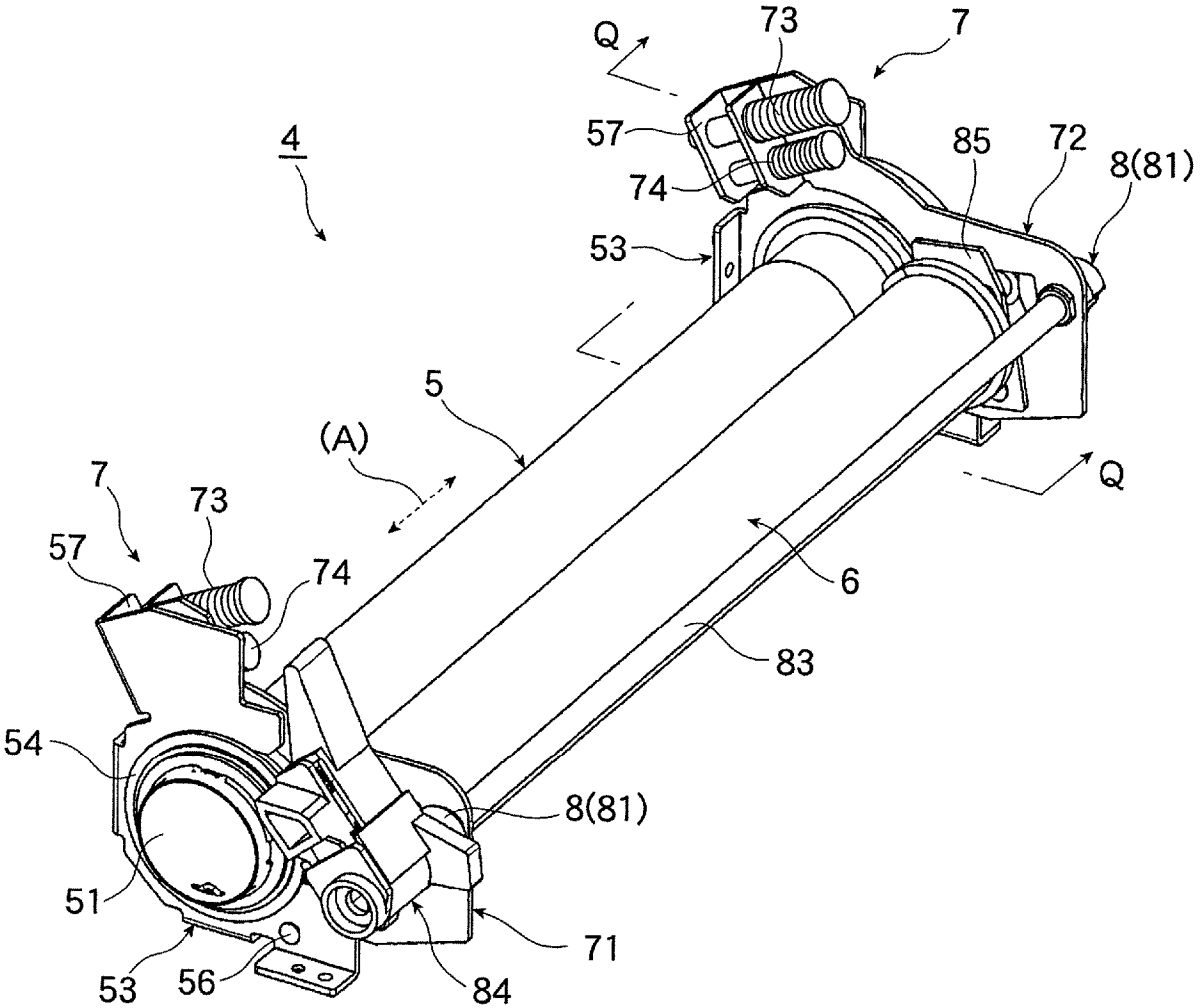
FIG. 2 is a perspective view showing the main portions of the fixing device for use in the image forming device shown in FIG. 1.
Figure 3:
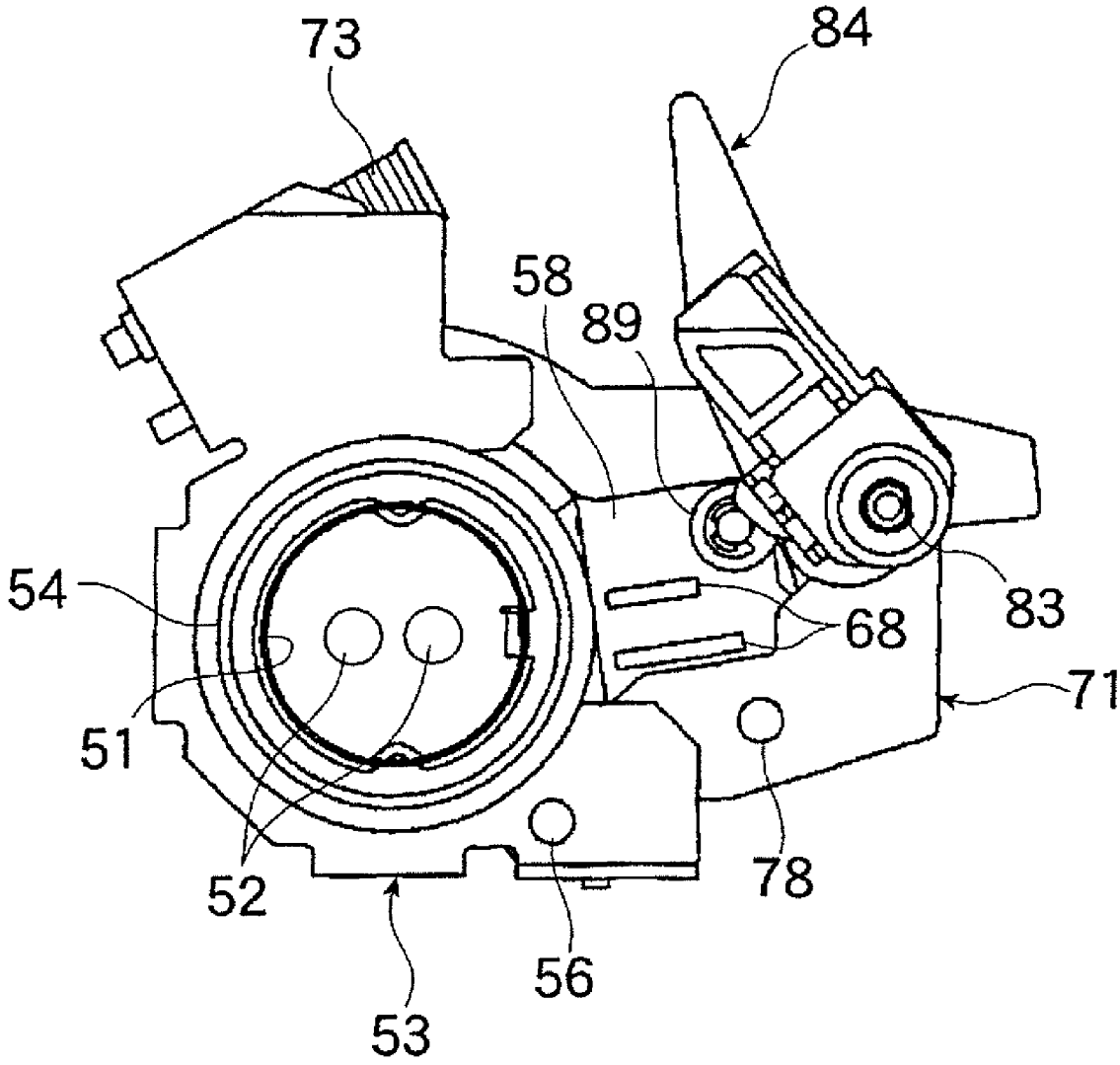
FIG. 3 is a front schematic view showing the fixing device shown in FIG. 2.

As shown in FIGS. 2 and 3, the fixing device 4 is equipped with the roll-shaped heating rotating body 5 and the belt-shaped pressurizing rotating body 6 as described above and further equipped with a pressing mechanism 7 for pressing the pressurizing rotating body 6 against the heating rotating body 5 and a switching mechanism 8 for switching the pressing state of the pressing mechanism 7.

The roll-shaped heating rotating body 5 mainly comprises a heating roll 51; a heating source 52 for heating the heating roll 51; and heating support frames 53 for rotatably supporting the heating roll 51 at both end portions thereof.

The heating roll 51 is configured such that an elastic layer and a releasing layer are formed in this order on the surface of a cylindrical substrate made of metal and having a length larger than the maximum conveying width of the recording medium 10 to be subjected to fixing. Furthermore, the heating roll 51 is installed on the support frames 53 via bearings 54 at both end portions thereof. Rotation drive power from the rotation drive portion disposed on the side of the main body of the image forming device 1 is transmitted to a gear 55 installed at one end portion of the roll and rotates the roll at a predetermined speed. A heating source 52 is, for example, formed of two halogen lamps installed inside the cylindrical portion of the heating roll 51 (see FIG. 3), and both end portions thereof are supported on the housing 40 of the fixing device 4. Moreover, the temperature of the surface of the heating roll 51 is detected using a temperature detector (not shown), and the heating operation of the heating source 52 is controlled on the basis of the detection information, whereby the temperature is maintained at a predetermined temperature.

The heating support frames 53 are provided with first support shafts 56 on the inner face sides of the regions 53*a* thereof on the recording medium 10 introduction side of the pressure-contact portion NP formed of the heating rotating body 5 and the pressurizing rotating body 6. The heating support frames 53 are further provided with spring support face portions 57, which are used in combination with the pressing mechanism 7, at the regions 53*b* on the recording medium discharging side of the pressure-contact portion NP. The spring support face portion 57 is formed so as to be bent inside the support frame 53. The heating support frames 53 are installed in a state of being secured to the housing 40 of the fixing device 4.

The belt-shaped pressurizing rotating body 6 mainly comprises an endless belt 61 rotating while making contact with the surface portion of the heating roll 51 along the direction A (see FIG. 2) of the rotation shaft thereof, a pressing body 62 for pressing the endless belt 61 against the surface portion of the heating roll 51 from the inner circumferential face side of the endless belt 61 to form the pressure-contact portion NP; and pressing support members 63 for rotatably supporting the endless belt 61 and for supporting the pressing body 62.

The endless belt 61 is a cylindrical belt having a width nearly equal to the length of the heating roll 51. As the endless belt 61, a belt is used in which a releasing layer made of fluororesin or the like is formed on the surface of a belt substrate made of synthetic resin, such as polyimide, and formed into a cylindrical shape having a thin wall.

Figure 4:
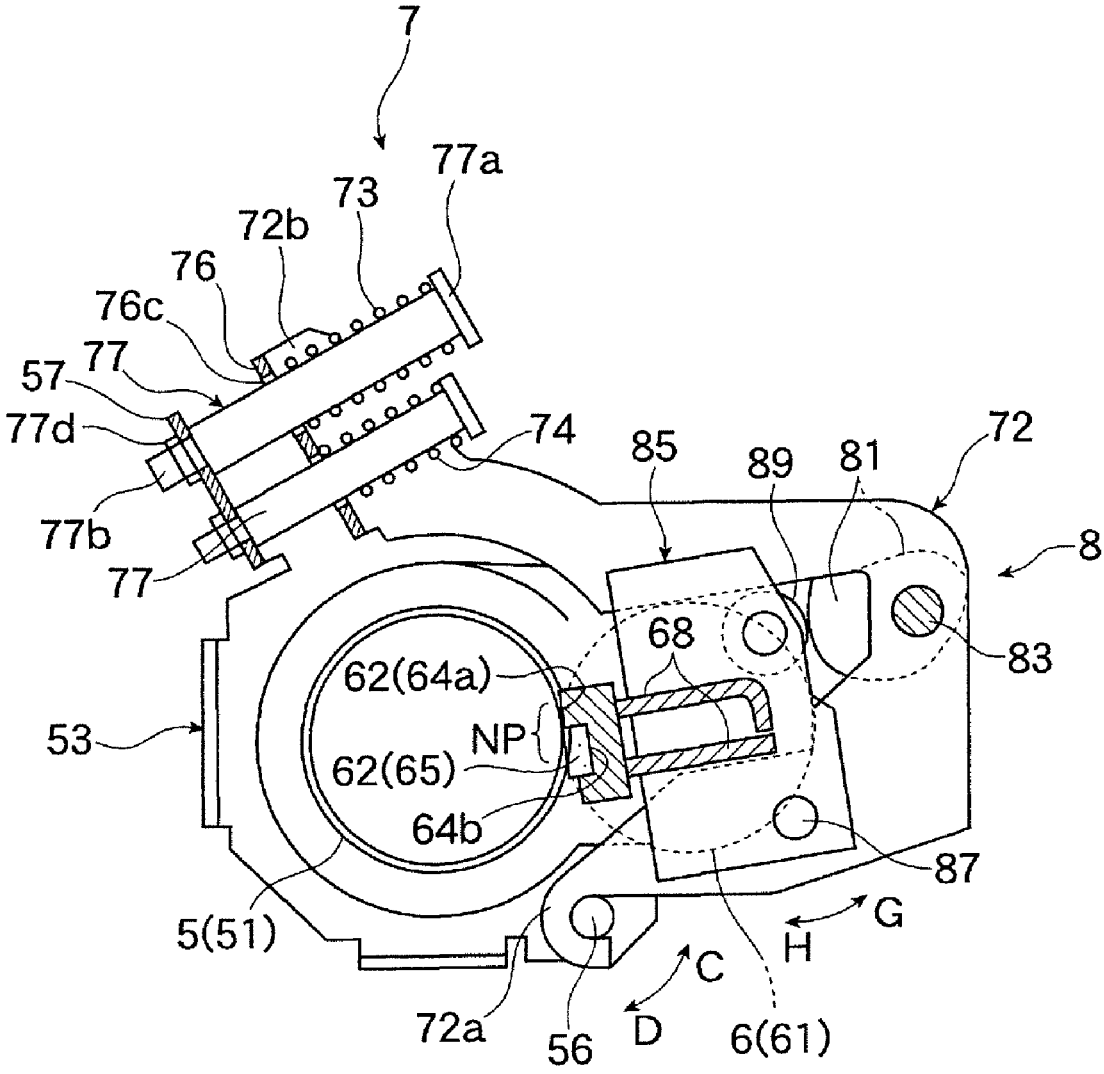
FIG. 4 is a partially sectional view showing the fixing device shown in FIG. 2, taken on line Q-Q thereof.

As shown in FIG. 4, the pressing body 62 comprises a head member 64 and a pad member 65 formed into a slender shape having a length nearly equal to the width of the endless belt 61. The head member 64 is formed of a non-elastic member made of synthetic resin, metal, etc. In this exemplary embodiment, the head member 64 is formed into a shape having a protruding portion 64*a*, which is disposed on the recording medium discharging side of the pressure-contact portion NP, for making the endless belt 61 to pressure contact with the surface of the heating roll 51; and a holding portion 64*b*, which is disposed on the recording medium introduction side of the pressure-contact portion NP, for holding the pad member 65. The pad member 65 is formed of an elastic member made of a rubber material or the like. In this exemplary embodiment, the pad member is made of silicone rubber and formed into a slender plate shape.

Figure 5:
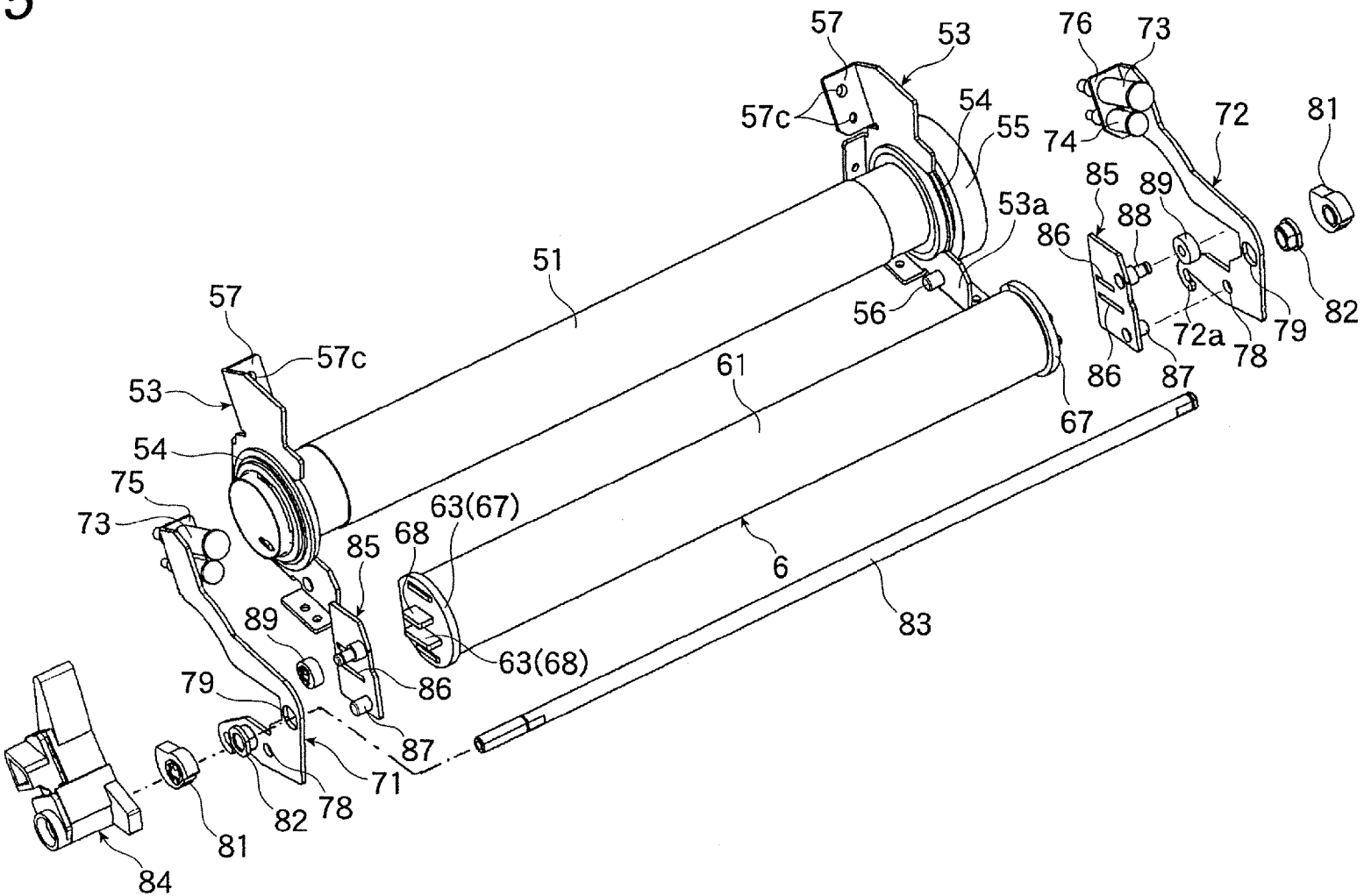
FIG. 5 is an exploded perspective view showing the fixing device shown in FIG. 2.

As shown in FIG. 5, etc., the pressing support member 63 mainly comprises a guide member 67 for rotatably guiding and supporting each of both end portions and part of the inner circumferential face of the endless belt 61; and support plates 68 for supporting the pressing body 62 by making contact with the rear face of (the head member 64) of the pressing body 62. The support plates 68, two in number, are used, and both end portions thereof are supported in a state of being inserted into mounting holes 86 formed in a second rocking support frame 85 described later.

The pressing mechanism 7 mainly comprises a pair of pressurizing rocking support frames 71 and 72 for supporting and rocking the belt-shaped pressurizing rotating body 6; and two compression coil springs 73 and 74, disposed in each of the pressurizing rocking support frames 71 and 72, for exerting forces for rocking (pressing) each of the support frames 71 and 72 in a direction of becoming close to the heating rotating body 5.

Each of the pair of pressurizing rocking support frames 71 and 72 is formed into a shape being bent once in a direction of becoming away from the heating roll 51 in a range between the region 53*a* of the heating support frame 53 on the recording medium introduction side thereof and the region 53*b* on the recording medium discharging side thereof.

The rocking support frames 71 and 72 have rocking fulcrum side end portions 71*a* and 72*a* that are formed into a hook shape curved at the tip on the recording medium introduction side of the pressure-contact portion NP. The rocking support frames 71 and 72 are rocked in the directions indicated by arrows C and D so as to become close to and away from the heating roll 51 while the end portions 71*a* and 72*a* are installed on the first support shafts 56 of the heating support frames 53. Each of spring pressing face portions 75 and 76 to which the forces of the two compression coil springs 73 and 74 are exerted is formed at each of the end portions 71*b* and 72*b* of the rocking support frames 71 and 72 on the recording medium discharging side thereof. The spring pressing face portions 75 and 76 are bent inward and formed so as to be opposed to the spring support face portions 57 of the heating support frames 53.

The compression coil springs 73 and 74 are formed of a first compression coil spring 73 having a large spring constant and a second compression coil spring 74 having a spring constant smaller than that of the first compression coil spring 73. In this exemplary embodiment, the free lengths (L1 and L2) of the coil springs 73 and 74 are identical to each other. However, the conditions, such as free lengths and spring constants, of the springs 73 and 74 may be set appropriately although these conditions will be described later.

Figure 7:
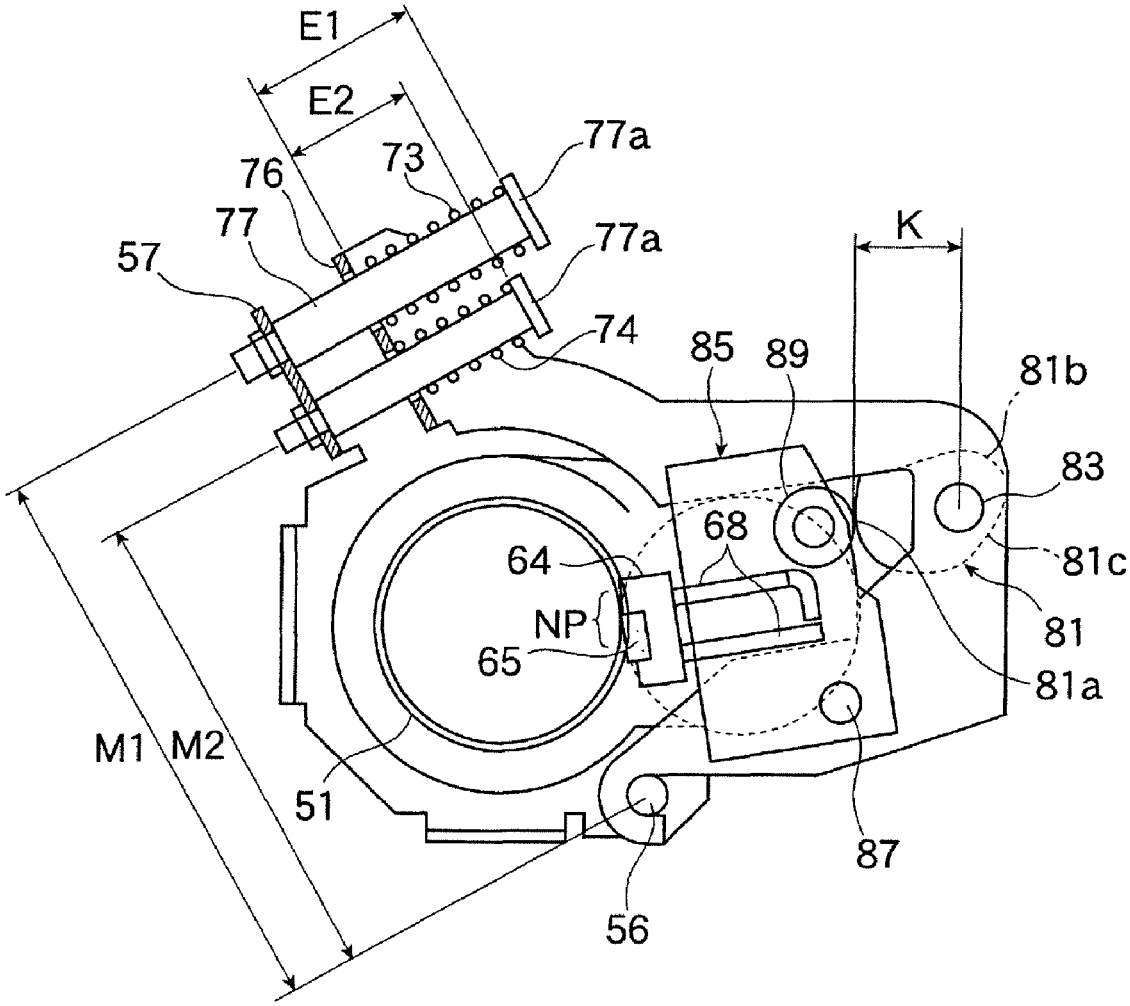
FIG. 7 is an explanatory view showing the configuration of the fixing device shown in FIG. 2.

Furthermore, the compression coil spring 73 and 74 are installed so as to be capable of pressing each of the spring pressing face portions 75 and 76 of the rocking support frames 71 and 72 so that the rocking support frames 71 and 72 are rocked in the direction C of becoming close to the heating roll 51. Moreover, the compression coil springs 73 and 74 are disposed at positions having distances M from the first support shaft 56, the distances being different from each other. In this exemplary embodiment, the first coil compression coil spring 73 is disposed at a farther position having a distance M1 from the first support shaft 56, and the second coil compression coil spring 74 is disposed at a nearer position having a distance M2 (<M1) from the first support shaft 56 (see FIG. 7).

In an actual configuration, as shown in FIG. 4, etc., each of the compression coil springs 73 and 74 is installed using a column 77 that is inserted into the coil winding space of the coil spring from the one end portion thereof and has a length protruding from the other end portion thereof (a dimension longer than the free length of the coil spring). A protruding portion 77*a* having a diameter larger than the outside diameter of the coil spring is formed at the upper portion of the main body of the column 77. On the other hand, a threaded portion 77*b* having a diameter smaller than that of the main body of the column is formed at the lower portion of the main body of the column. In this exemplary embodiment, the length of (the main body of) the column 77 for the first coil compression coil spring 73 is made larger than the length of the column 77 for the second coil compression coil spring 74.

For the purpose of installing the compression coil springs 73 and 74, first, the column 77 is inserted into the winding space of each of the compression coil springs 73 and 74 while the lower portion of the column 77 is oriented ahead, and the main body of the column protruding from the lower end portion of each coil spring is passed through a column passing hole 76*c* (a hole having a diameter smaller than the outside diameter of the coil spring) formed in each of the spring pressing face portions 75 and 76 of the pressurizing rocking support frames 71 and 72 so as to protrude therefrom. Then, the threaded portion 77*b* of the column protruding from the column passing hole 76*c* is fitted into a column installing hole 57*c* formed in the spring support face portion 57 of the heating support frame 53, and finally, tightened with a nut 77*d* to secure the column.

The pressing mechanism 7 holds each of the compression coil springs 73 and 74 so as to be held between the protruding portion 77*a* of the column secured to the spring support face portion 57 of the heating support frame 53 and each of the spring pressing face portions 75 and 76 of the pressurizing rocking support frames so that the spring is compressed a predetermined compression amount. The compression amount (P) of the compression coil spring at this time is nearly equivalent to the value obtained by subtracting the distance E between each of the spring pressing face portions 75 and 76 and the protruding portion 77*a* of the column from the free length (L) of the compression coil spring (P=L−E, see FIG. 7). The protruding portion 77*a* of the column is maintained at a constant position since the column 77 is secured to each of the spring pressing face portions 75 and 76.

Furthermore, in the pressing mechanism 7, the compression coil springs 73 and 74 press each of the spring pressing face portions 75 and 76 of the pressurizing rocking support frames 71 and 72 in a direction of moving each of the spring pressing face portions 75 and 76 close to the spring support face portion 57 of the heating support frame 53 using the spring forces F1 and F2 of the compression coil springs 73 and 74 exerted depending on the compression amounts and the spring constants thereof obtained at the time. As a result, the pressurizing rocking support frames 71 and 72 are wholly pressed so as to be rocked (in the direction indicated by arrow C) in a direction of becoming close to the heating roll 51.

The switching mechanism 8 is used to perform switching among three states: a first pressing state in which the two compression coil springs 73 and 74 (a pair) disposed on each of both end portions of the pressurizing rotating body 6 of the pressing mechanism 7 are maintained compressed (a state when the "normal mode" described later is selected); a second pressing state in which one of the two compression coil springs 73 and 74 (the first coil compression coil spring 73 in this exemplary embodiment) is maintained in its free length state (a state when the "envelope mode" described later is selected); and a third pressing state in which the spring forces of the two compression coil springs 73 and 74 are not exerted to the pressurizing rotating body 6 (a state when the "jam elimination mode" described later is selected).

This fixing device 4 herein has a structure in which the pressing support member 63 is installed on each of the pressurizing rocking support frames 71 and 72 via the second rocking support frame 85 described below so that the pressing portion (pressing portion) of the pressing body 62 of the pressurizing rotating body 6, for pressing the endless belt 61 against the heating roll 51, is changed in synchronization with the switching operation of the switching mechanism 8 between the first pressing state and the second pressing state. In this exemplary embodiment, during the first pressing state, both the head member 64 and the pad member 65 of the pressing body 62 are set to press the endless belt, and during the second pressing state, only the pad member 65 of the pressing body 62 is set to press the endless belt.

As shown in FIGS. 3 to 5, the second rocking support frame 85 is a plate having a nearly rectangular shape and disposed so as to be adjacent to each of both ends of the pressing support members 63. The rocking support frame 85 supports the pressing support member 63 by fitting the end portions of the support plates 68 of the pressing support member 63 into the installation holes 86 formed in the central portion of the frame. Furthermore, a second support shaft 87 provided so as to face outside at a corner portion of the frame on the recording medium introduction side of the pressure-contact portion NP is fitted into a support hole 78 formed near the end portion 72*a* of each of the pressurizing rocking support frames 71 and 72 on the rocking fulcrum side thereof from inside each of the support frames 71 and 72, thereby being installed rotatably.

Hence, the second rocking support frame 85 is rocked in the directions indicated by arrows G and H with the second support shaft 87 being used as a fulcrum so that the pressing body 62 moves to the introduction side and the discharging side of the recording medium 10 at the pressure-contact portion NP. The rocking support frame 85 is held at a predetermined rocking state using the switching mechanism 8 as desired later.

The switching mechanism 8 is formed of cams 81 for rocking the pressurizing rocking support frames 71 and 72 from the position corresponding to the first pressing state to the positions corresponding to the second and third pressing states. In addition, the switching mechanism 8 also has a function of rocking the second rocking support frames 85 to the position in which the pressing portion of the pressing body 62 may be changed. Hence, the cams 81 are provided on the pressurizing rocking support frames 71 and 72.

The cams 81 are rotatably installed on the pressurizing rocking support frames 71 and 72 and also installed so as to make contact with the second rocking support frames 85. In this exemplary embodiment, the cams 81 are installed on a cam rotation shaft 83 rotatably installed on the bent portions of the pressurizing rocking support frames 71 and 72 at portions slightly away from the pressure-contact portion NP to the recording medium discharging side, and also installed so as to be secured at the outside positions of the pressurizing rocking support frames 71 and 72. The cam rotation shaft 83 is installed in camshaft installation holes 79 provided in the above-mentioned portions of the pressurizing rocking support frames 71 and 72 via bearings 82. At one end portion 83*a* of the cam rotation shaft 83, a lever 84 that is operated to rotate the cam rotation shaft 83 (eventually the cams 81) is installed.

Figure 6:
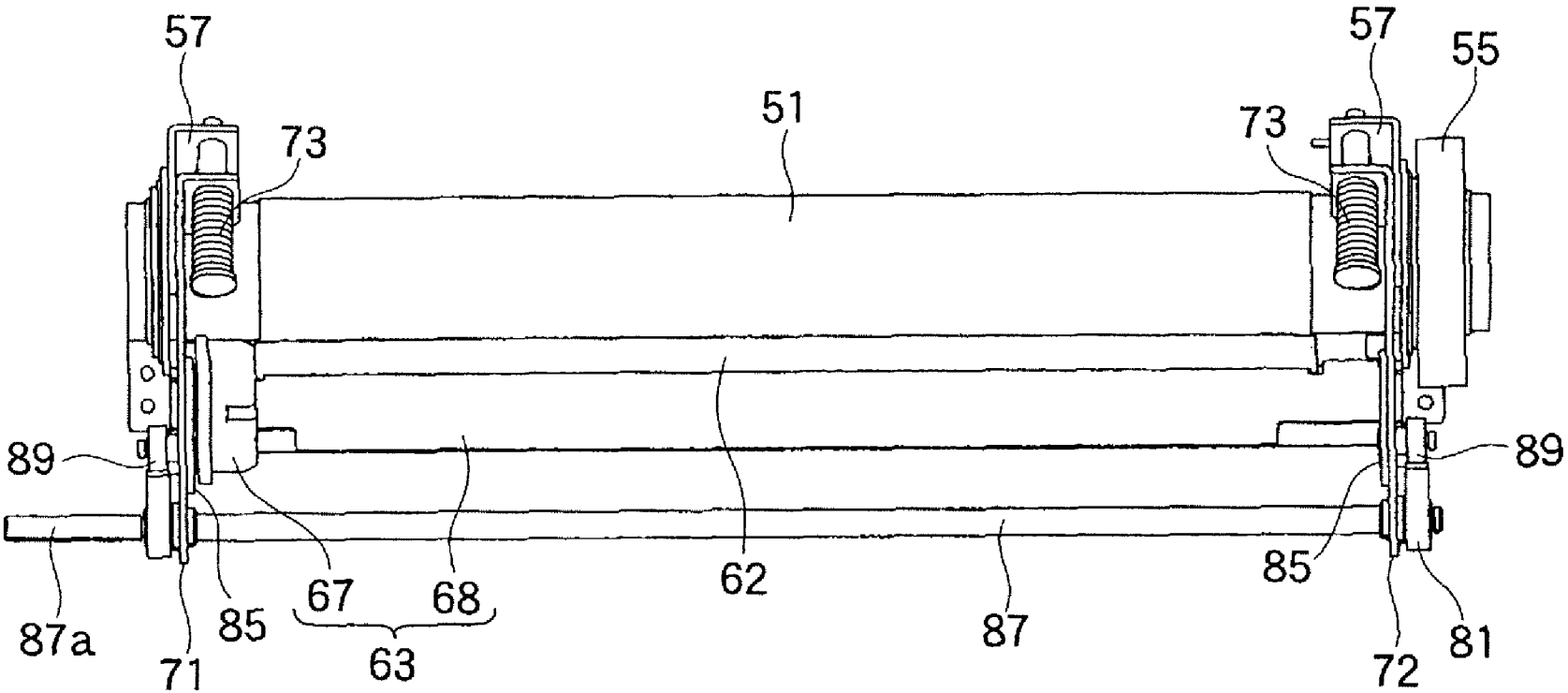
FIG. 6 is a top view showing the fixing device shown in FIG. 2, part of which is omitted.

In addition, the cam 81 is not configured so as to make direct contact with the second rocking support frame 85 but is configured so as to make indirect contact therewith via a disc-shaped cam receiver 89 installed outside the corner portion of the second rocking support frame 85 slightly dislocated from the pressure-contact portion NP to the recording medium discharging side. The cam receiver 89 is rotatably installed on an installation shaft 88 provided on the above-mentioned corner portion of the second rocking support frame 85 so as to face outside (see FIG. 5), and is disposed so as to pass through the bent portion of each of the rocking support frames 71 and 72 and make contact with the cam 81 at the position outside each of the frames (see FIG. 6).

Furthermore, the cam 81 has three cam faces: a first cam face 81*a*, a second cam face 81*b* and a third cam face 81*c*, for adjusting distance K (see FIG. 7) from (the cam rotation shaft 83) to a contact point at which the cam makes contact with the cam receiver 89 of the second rocking support frame 85.

Among the three cam faces, the first cam face 81*a* is a face formed at a position (K1: the radius of the cam) farthest from the cam rotation shaft 83 and is used to serve as a cam face for obtaining the above-mentioned first pressing state. The second cam face 81*b* is a face formed at a position (K2<K1) closer to the cam rotation shaft 83 than the first cam face 81*a* and is used to serve as a cam face for obtaining the above-mentioned second pressing state. The third cam face 81*c* is a face formed at a position (K3<K2) closer to the cam rotation shaft 83 than the second cam face 81*b* and is used to serve as a cam face for obtaining the above-mentioned third pressing state. For reference's sake, the distance K3 from the third cam face 81*c* to the cam rotation shaft 83 is set so as to satisfy a condition in which the pressurizing rocking support frames 71 and 72 are rocked in the direction indicated by arrow C and the spring pressing face portions 75 and 76 thereof are struck against the spring support face portions 57 of the heating support frames 53 and to satisfy a condition in which the second rocking support frames 85 are allowed to be rocked so that the pressing body 62 is moved easily to the recording medium discharging side at the pressure-contact portion NP.

The cam 81 is placed in a state in which any one of the above-mentioned three cam faces makes contact with the cam receiver 89. In addition, by rotating the lever 84 so as to be inclined in a predetermined direction, the cam rotation shaft 83 is rotated, and the cam face making contact with the cam receiver 89 is switched and maintained.

Next, the operation of the fixing device 4 will be described below.

First, the operation of the fixing device 4 in the case that image formation (including fixing) is performed using a sheet-shaped recording medium (other than an envelop-shaped recording medium) as the recording medium 10 (hereafter, this case is referred to as the "normal mode") is described below.

Figure 8:
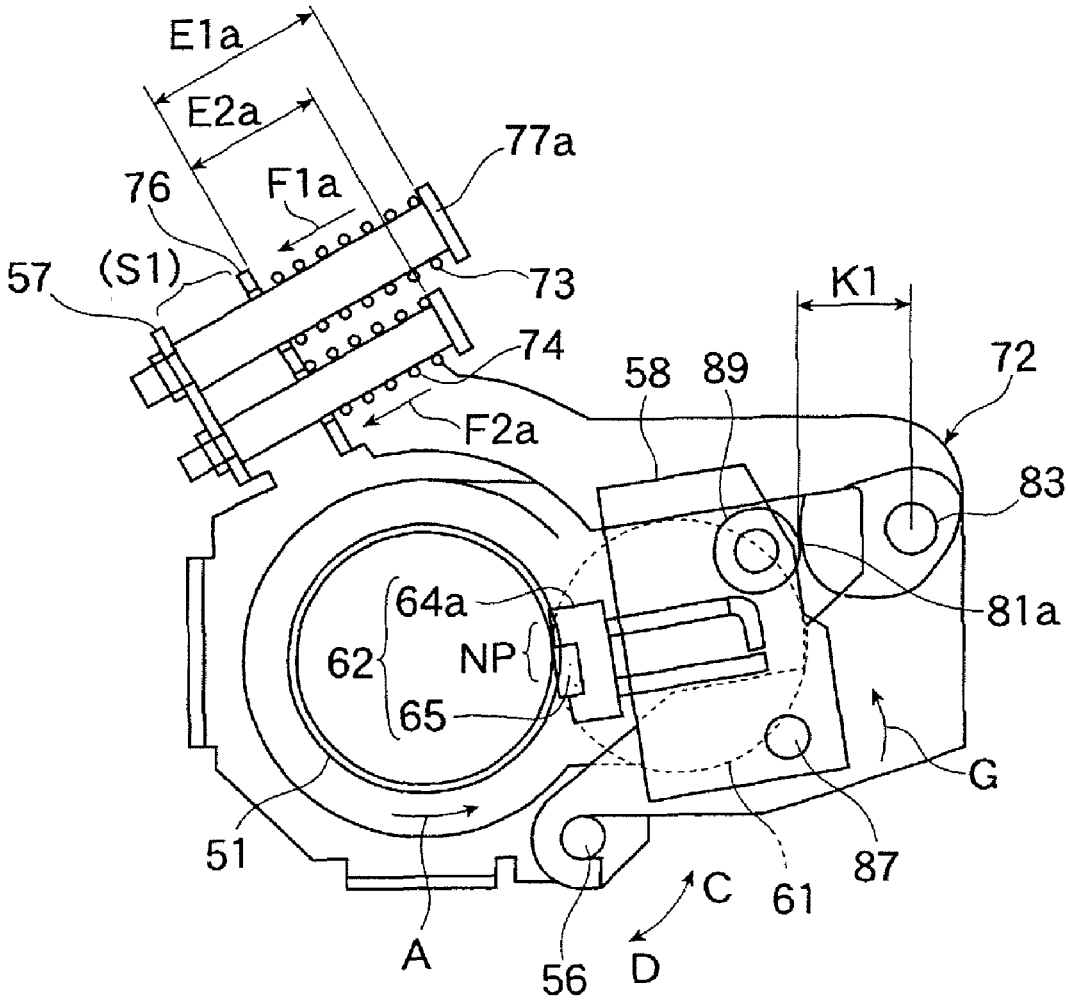
FIG. 8 is an explanatory view showing a state in the normal mode of the fixing device shown in FIG. 2.

When the normal mode is selected in the fixing device 4, by operating the lever 84 of the switching mechanism 8 to rotate the cam 81, the cam 81 is maintained in a state of making contact with the cam receiver 89 at the first cam face 81*a* thereof as shown in FIG. 8, etc.

Hence, the cam rotation shaft 83 of the cam 81 is in a state of having moved to the position farthest from the cam receiver 89 (away therefrom by distance K1). At this time, the pressurizing rocking support frames 71 and 72 on which the cams 81 and the cam rotation shaft 83 are installed are rocked in the direction indicated by arrow D with the first support shaft 56 being used as a fulcrum so as to be away from the heating roll 51. As a result, the spring pressing face portions 75 and 76 of the rocking support frames 71 and 72 are moved away from the spring support face portions 57 of the heating support frames 53 and maintained at a position spaced by a predetermined distance (S1).

By the operation of the switching mechanism 8, in the pressing mechanism 7, the distances E1 and E2 between the protruding portions 77*a* of the columns for the first compression coil spring 73 and the second compression coil spring 74 and each of the spring pressing face portions 75 and 76 are set to distances (E1*a* and E2*a*) for the normal mode. The distances E1*a* and E2*a* for the normal mode are set to values smaller than the free length L1 of the first compression coil spring 73 and the free length L2 of the second compression coil spring 74. For this reason, both the two compression coil springs 73 and 74 are maintained in a compressed state (this is the "first pressing state"). At this time, the compression amount P1 of the first compression coil spring 73 is "P1=L1−E1*a*" and the compression amount P2 of the second compression coil spring 74 is "P2=L2−E2*a*".

Hence, in the normal mode, the first compression coil spring 73 and the second compression coil spring 74 exert spring forces F1*a* and F2*a* (=compression amount×spring constant) corresponding to the compression amount and the spring constant of each coil spring, and the spring pressing face portion 76 is pressed continuously in a direction of becoming close to the spring support face portion 57 by the spring forces F1*a* and F2*a* of the two compression coil springs 73 and 74. As a result, the pressurizing rocking support frames 71 and 72 are maintained in a state of being rocked to the side becoming close to the heating roll 51 (in the direction indicated by arrow C). At this time, to the pressurizing rocking support frames 71 and 72, the "principle of leverage" is applied such that the first support shaft 56 is used as the fulcrum, each of the spring pressing face portions 75 and 76 is used as a point to which the force is applied, and the cam 81 is used as the point of action, whereby the spring forces F1*a* and F2*a* are transmitted to the cam 81 as forces amplified by the principle of leverage.

As a result, the pressurizing rocking support frames 71 and 72 press the second rocking support frames 85 via the cams 81 and the cam receivers 89 in a direction of moving the second rocking support frames 85 close to the heating roll 51, whereby the pressing body 62 supported on the rocking support frames 85 via the pressing support members 63 is pressed against the heating roll 51 by high pressure X required during fixing in the normal mode. At this time, a reaction force is generated from the heating roll 51 being in a secured state as a reaction for the above-mentioned pressure X. The reaction force is balanced with the load (pressing force) caused by the pressing mechanism 7, and the pressurizing rocking support frames 71 and 72 become stationary.

Furthermore, in the normal mode, the pressurizing rocking support frames 71 and 72 of the pressing mechanism 7 are maintained in a state of being rocked in a direction of moving the second rocking support frames 85 close to the heating roll 51 via the cams 81.

Hence, the second rocking support frame 85 is maintained in a state of being rocked in the direction indicated by arrow G with the second support shaft 87 being used as a fulcrum, and the pressing body 62 is maintained in a state of being moved to the recording medium 10 introduction side of the pressure-contact portion NP, and finally, both (the protruding portion 64*a*) of the head member 64 and the pad member 65 of the pressing body 62 are maintained in a state of pressing the endless belt 61 against the heating roll 51. The rocking of the second rocking support frame 85 in the direction indicated by arrow G at this time is stopped (its stop position is determined) at the position determined on the basis of the physical properties (for example, the elastic coefficients of the elastic layer and the elastic material) of the surfaces of the heating roll 51 and the pressurizing rotating body 6 and the state of pressing therebetween.

As a result, in the normal mode, the above-mentioned high pressure X for fixing is applied to the pressure-contact portion NP of the fixing device 4 via the pressing body 62, and the pressure-contact portion NP is formed by the pressing using both the protruding portion 64*a* of the head member 64 and the pad member 65 of the pressing body 62.

When the sheet-shaped recording medium 10 to be subjected to fixing in the normal mode is introduced into the pressure-contact portion NP, first, the pad member 65 disposed on the recording medium introduction side of the pressure-contact portion NP presses the heating roll 51 (via the endless belt 61) that rotates while heating the recording medium 10. Then, (the protruding portion 64*a* of) the head member 64 disposed on the recording medium discharging side of the pressure-contact portion NP presses the recording medium 10 against the above-mentioned heating roll 51 (via the endless belt 61). In this way, fixing is performed for the sheet-shaped recording medium 10.

Figure 11A:
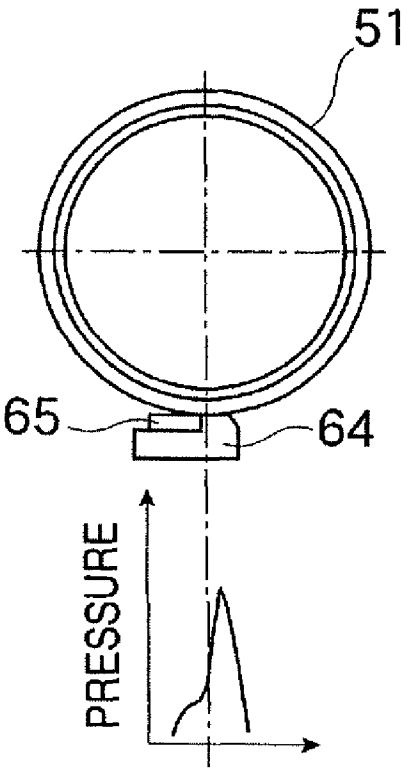
FIG. 11A are explanatory views showing pressure distribution states in the normal mode of the fixing device shown in FIG. 2.

With respect to the pressure (distribution) applied to the pressure-contact portion NP of the heating roll 51 in the normal mode, the pressure exerted using the head member 64 disposed on the recording medium discharging side of the pressure-contact portion NP becomes higher than the pressure exerted using the pad member 65 disposed on the recording medium introduction side as shown in FIG. 11A. For reference's sake, for example, approximately 250 N is required as the pressure applied to the pressure-contact portion NP of the heating roll 51 in the normal mode. For the purpose of obtaining this pressure, the spring constants, compression amounts, etc. of the two compression coil springs 73 and 74 in the pressing mechanism 7 are selectively determined. In addition, since the fixing is done under such high pressure, the fixing is performed stably when the sheet-shaped recording medium 10 is used.

Next, the operation of the fixing device 4 in the case that image formation is performed using an envelop-shaped recording medium typified by an envelope as the recording medium 10 (hereafter, this case is referred to as the "envelope mode") is described below.

Figure 9:
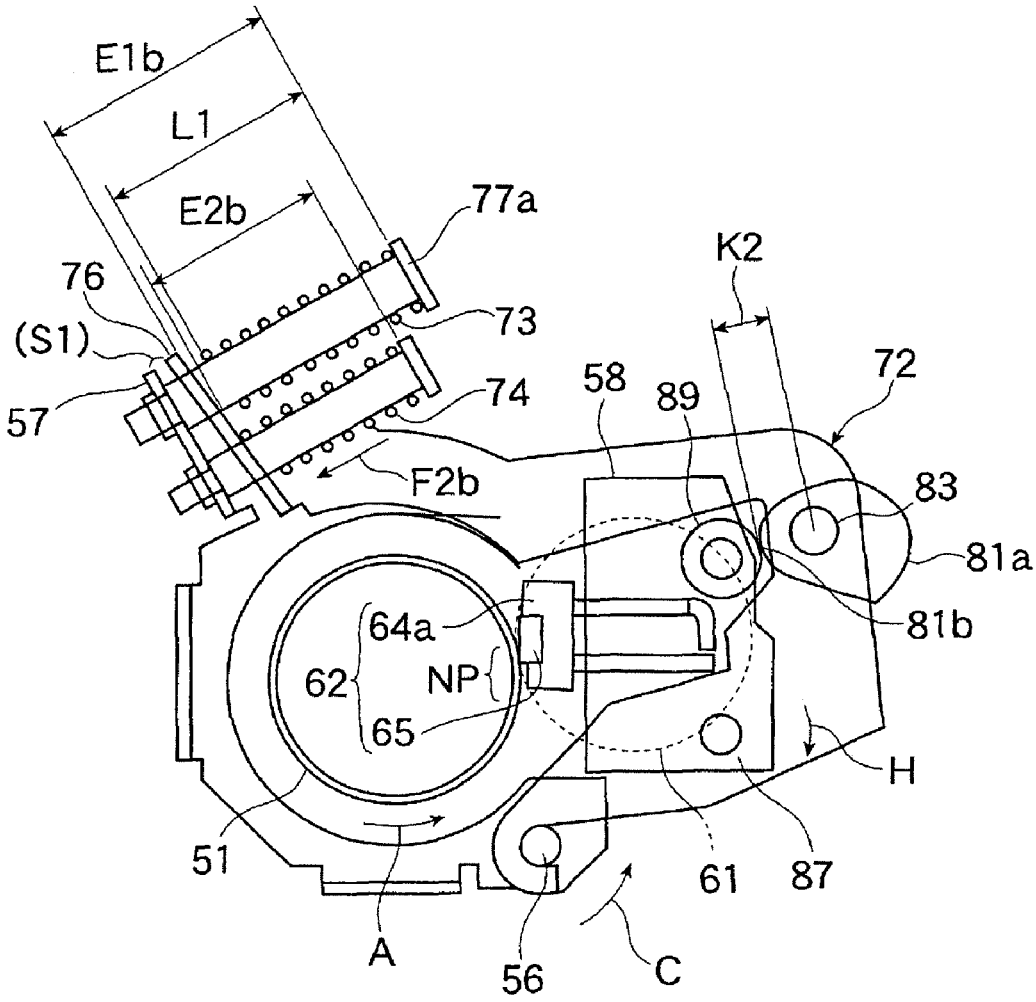
FIG. 9 is an explanatory view showing a state in the envelope mode of the fixing device shown in FIG. 2.

When the envelope mode is selected in the fixing device 4, by operating the lever 84 of the switching mechanism 8 to rotate the cam 81 in a predetermined direction, the cam 81 is maintained in a state of making contact with the cam receiver 89 at the second cam face 81*b* thereof as shown in FIG. 9, etc.

Hence, the rotation shaft 83 of the cam 81 is in a state of having moved to a position (distance K2) that is closer to the cam receiver 89 than the position in the case of the first cam face 81*a*. At this time, the pressurizing rocking support frames 71 and 72 are rocked in a direction of becoming close to the heating roll 51 as indicated by arrow C. As a result, the spring pressing face portions 75 and 76 of the pressurizing rocking support frames 71 and 72 are moved in a direction of becoming close to the spring support face portions 57 and maintained at a position spaced by a predetermined distance (S2>S1).

By the operation of the switching mechanism 8, in the pressing mechanism 7, the distances E1 and E2 between the protruding portions 77*a* of the columns for the two compression coil springs 73 and 74 and each of the spring pressing face portions 75 and 76 are set to distances (E1*b* and E2*b*) for the envelope mode. The distance E1*b* for the envelope mode is set to a value larger than the free length L1 of the first compression coil spring 73. On the other hand, the distance E2*b* is set to a value smaller than the free length L2 of the second compression coil spring 74. Furthermore, in the pressing mechanism 7, since the first compression coil spring 73 is disposed at the position (distance M1) that is farther away from the first support shaft 56 than the position in the case of the second compression coil spring 74, the distance E1*b* in the case of the first compression coil spring 73 becomes larger than the distance E2*b* in the case of the second compression coil spring 74.

For this reason, in the pressing mechanism 7, the length of the first compression coil spring 73 becomes its free length (L1) and the coil spring is not compressed at all. On the other hand, the second compression coil spring 74 slightly extends in comparison with its length in the first pressing state and is maintained in a slightly compressed state (this is the "second pressing state"). The compression amount P2 of the second compression coil spring 74 at this time becomes "P2=L2−E2*b*". Since the first compression coil spring 73 is not compressed, it is nullified.

Hence, only the second compression coil spring 74 in the pressing mechanism 7 exerts a spring force F2*b* (=compression amount×spring constant) depending on the compression amount and spring constant thereof. The spring force F2*b* of the second compression coil spring 74 continuously presses each of the spring pressing face portions 75 and 76 in a direction of moving each of the spring pressing face portions 75 and 76 close to the spring support face portion 57, whereby the pressurizing rocking support frames 71 and 72 are maintained in a state of being rocked to the side becoming close to the heating roll 51 (in the direction indicated by arrow C). At this time, the "principle of leverage" is applied to the pressurizing rocking support frames 71 and 72 as in the case of the normal mode. However, only the spring force F2*b* of the second compression coil spring 74 is amplified by the principle of leverage, a force weaker than that in the normal mode is transmitted to the cam 81 serving as the point of action. In addition, the spring force F2*b* itself becomes weak since the second compression coil spring 74 is in a state in which its length is extended and its compression amount is reduced in comparison with the state in the normal mode.

As a result, in the envelope mode, although the pressurizing rocking support frames 71 and 72 press the second rocking support frames 85 in a direction of moving the second rocking support frames 85 close to the heating roll 51 as in the case of the normal mode, since the force transmitted to the cams 81 is weaker than that in the normal mode, the pressing body 62 supported on the rocking support frames 85 is pressed against the heating roll 51 by pressure Y (<X) lower than the high pressure X required during fixing in the normal mode.

Furthermore, even in the envelope mode, as in the case of the normal mode, the pressurizing rocking support frames 71 and 72 of the pressing mechanism 7 maintain the second rocking support frames 85 in a rocked state in a direction of moving the second rocking support frames 85 close to the heating roll 51 via the cams 81.

However, in this case, the force of the pressurizing rocking support frames 71 and 72 pressing the second rocking support frames 85 is weaker than that in the normal mode, and the force of the pressing body 62 pressing the heating roll 51 is also weak. Hence, the pressing body 62 receives, for example, a force generated by the friction between the heating roll 51 rotating in the direction indicated by arrow A and the endless belt 61 being driven and rotated. Consequently, the second rocking support frames 85 are maintained in a state of being rocked in the direction indicated by arrow H with the second support shafts 87 being used as a fulcrum.

As a result, since the pressing body 62 is maintained in a state of being moved to the recording medium 10 discharging side of the pressure-contact portion NP, the state of pressing the heating roll 51 becomes as described below (changed). That is, (the protruding portion 64*a*) of the head member 64 of the pressing body 62 is moved in a direction of becoming away from the heating roll 51 and is set in a state of not pressing the heating roll 51. On the other hand, only the pad member 65 thereof is moved to a position opposed to the heating roll 51 and is set in a state of pressing the endless belt 61 against the heating roll 51.

As described above, in the envelope mode, the above-mentioned low pressure Y for the envelope mode is applied to the pressure-contact portion NP of the fixing device 4 via the pressing body 62, and the pressure-contact portion NP is formed by the pressing using only the pad member 65 (formed of an elastic member) of the pressing body 62.

Furthermore, when the envelop-shaped recording medium 10 to be subjected to fixing is introduced into the pressure-contact portion NP in the envelope mode, only the elastic pad member 65 to which the low pressure Y is applied presses the recording medium 10 against the heating roll 51 (via the endless belt 61). Hence, in the envelope mode, the fixing for the envelop-shaped recording medium 10 is performed under an environment in which the pressure is lower than that in the normal mode, the pressure-contact portion NP is elastically deformed depending on the passing state of the recording medium 10, and the pressurizing rocking support frames 71 and 72 are rocked by a necessary amount with respect to the heating support frames 53 and balanced mutually (dynamically) depending on the passing state of the recording medium. In addition, in the envelope mode, the compression coil springs 73 and 74 of the pressing mechanism 7 are not further compressed forcibly unlike the case of the normal mode. For this reason, the compression coil springs 73 and 74 are free from shrinkage and sagging that may occur if there is a period during which the springs are set in a forcibly compressed state.

Figure 11B:
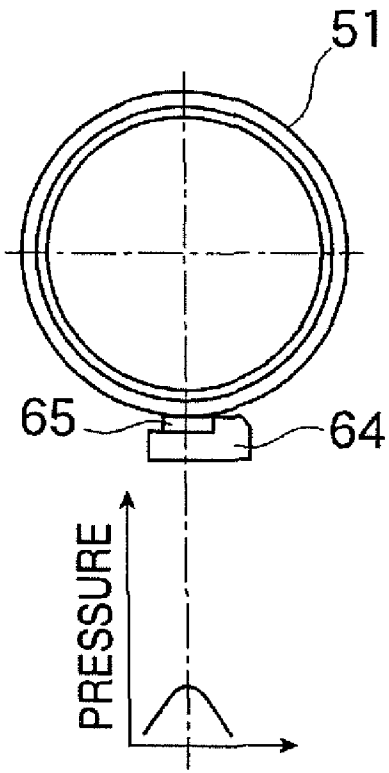
FIG. 11B are explanatory views showing pressure distribution states the envelope mode of the fixing device shown in FIG. 2.
Figure 11C:
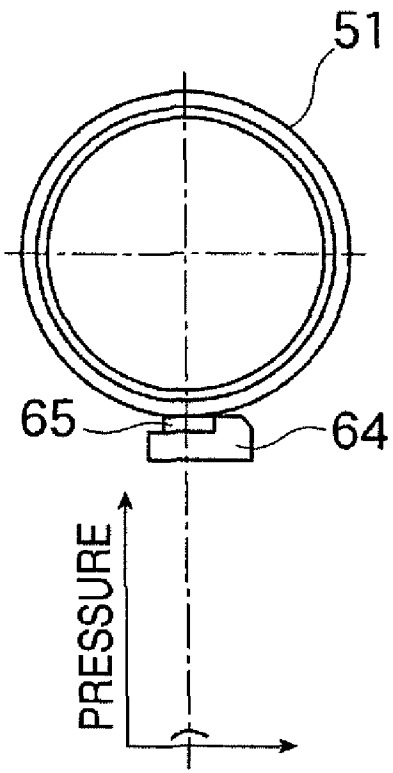
FIG. 11C are explanatory views showing pressure distribution states the jam elimination mode of the fixing device shown in FIG. 2.

The pressure (distribution) applied to the pressure-contact portion NP of the heating roll 51 in the envelope mode is a low pressure since only the pressure exerted using the pad member 65 is applied, as shown in FIG. 11B. This pressure is a low pressure in comparison with the pressure applied in the normal mode (see FIG. 11A). In addition, since the pad member 65 is an elastic member, elastic deformation is apt to occur on the side of the pad member 65 at the pressure-contact portion NP. For this reason, the pressure applied to the pressure-contact portion NP of the heating roll 51 in the envelope mode becomes a low pressure of approximately 30 to 40 N, for example.

In particular, in the envelope mode of the fixing device 4, the pressure applied to the pressing body 62 using the pressing mechanism 7 is lowered, and only the elastic pad member 65 presses the endless belt 61 against the heating roll 51. Hence, even when the envelop-shaped recording medium 10 is subjected to fixing, no wrinkles occur on the recording medium 10 (in its rear region in the conveying direction in particular), and stable and favorable fixing is made possible. For reference's sake, in the fixing device 4, when the envelop-shaped recording medium 10 is subjected to fixing under the conditions that only the pressure applied to the pressing body 62 using the pressing mechanism 7 is set low and that the pressure-contact portion NP is set to the pressing state using both the head member 64 and the pad member 65 as in the case of the normal mode, it is confirmed that wrinkles occurred occasionally on the recording medium 10 (in its rear region in the conveying direction).

Next, when a phenomenon in which the recording medium 10 is held and jammed at the pressure-contact portion NP of the fixing device 4 (a jamming phenomenon) occurs, operation to be performed in the case of removing the jammed recording medium 10 from the fixing device 4 will be described below (hereafter, this case is referred to as the "jam elimination mode").

Figure 10:
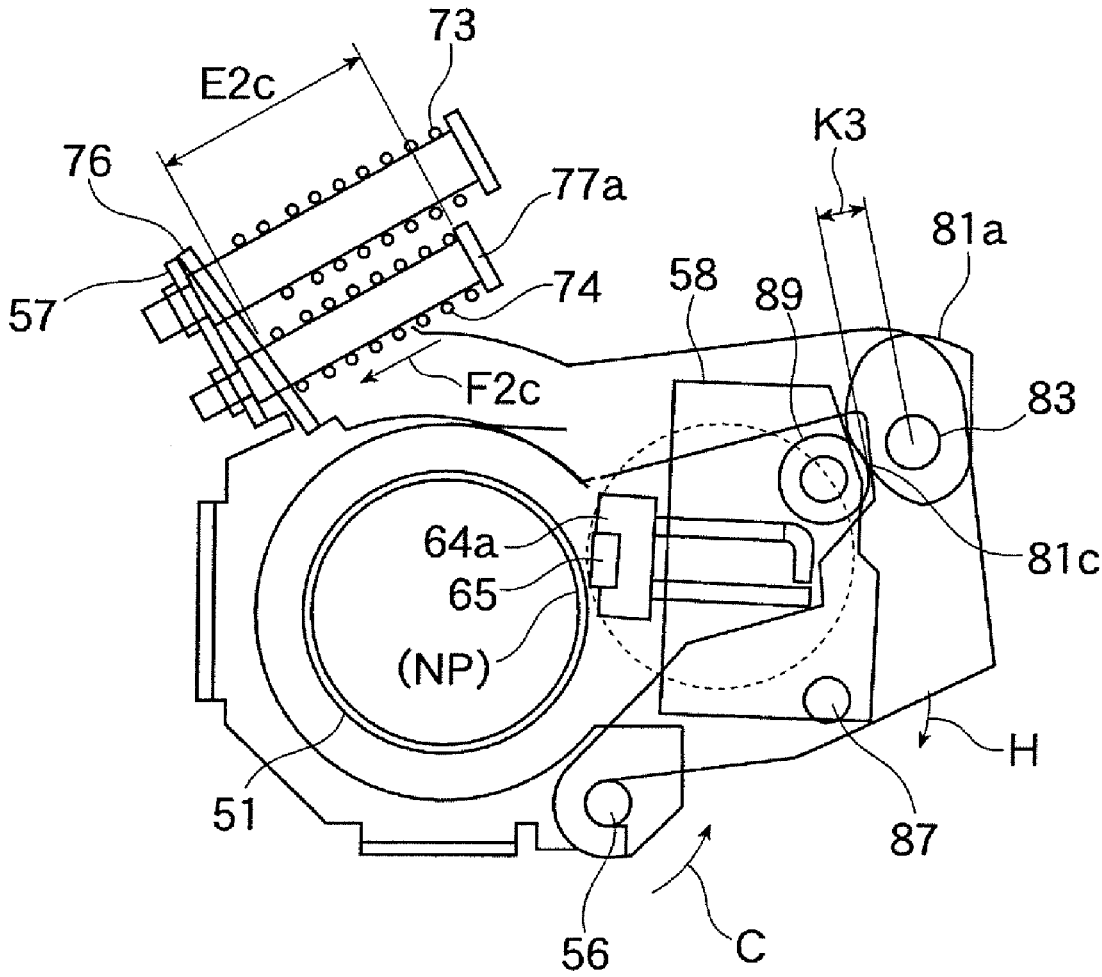
FIG. 10 is an explanatory view showing a state in the jam elimination mode of the fixing device shown in FIG. 2.

When the jam elimination mode is selected in the fixing device 4, by operating the lever 84 of the switching mechanism 8 to rotate the cam 81 in a predetermined direction, the cam 81 is maintained in a state of making contact with the cam receiver 89 at the third cam face 81*c* thereof as shown in FIG. 10, etc.

Hence, the cam rotation shaft 83 of the cam 81 is in a state of having moved to a position (distance K3) that is closer to the cam receiver 89 than the position in the case of the second cam face 81*b*. At this time, the pressurizing rocking support frames 71 and 72 are rocked in the direction indicated by arrow C so as to become close to the heating roll 51. As a result, the spring pressing face portions 75 and 76 of the rocking support frames 71 and 72 are struck against the spring support face portions 57 of the heating support frames 53 and maintained at the struck state.

By the operation of the switching mechanism 8, in the pressing mechanism 7, the distances E1 and E2 between the protruding portions 77*a* of the columns for the two compression coil springs 73 and 74 and each of the spring pressing face portions 75 and 76 are set to distances (E1*c* and E2*c*) for the jam elimination mode. The distance E1*c* for the jam elimination mode is set to a value larger than the free length L1 of the first compression coil spring 73. On the other hand, the distance E2*c* for the jam elimination mode is set to a value smaller than the free length L2 of the second compression coil spring 74 (but set to a value larger than the distance E2*b* in the envelope mode).

For this reason, in the pressing mechanism 7, nearly as in the case of the envelope mode, the length of the first compression coil spring 73 becomes its free length and the coil spring is not compressed at all, and the second compression coil spring 74 slightly extends in comparison with its length in the second pressing state and is maintained in a slightly compressed state. Furthermore, the pressurizing rocking support frames 71 and 72 are maintained in a state of not being further rocked to the side becoming close to the heating roll 51 (in the direction indicated by arrow C) (this is the "third pressing state"). The compression amount P3 of the second compression coil spring 74 at this time is "P2=L2−E2*c*".

As a result, only the second compression coil spring 74 in the pressing mechanism 7 exerts a spring force F2*c* depending on the compression amount and spring constant thereof, thereby continuously pressing each of the spring pressing face portions 75 and 76 in a direction of moving each of the spring pressing face portions 75 and 76 close to the spring support face portion 57. However, in this case, since the spring pressing face portions 75 and 76 are struck against the spring support face portions 57, the pressurizing rocking support frames 71 and 72 are prevented from being rocked to the side becoming closer to the heating roll 51 from the struck position (in the direction indicated by arrow C) even if the spring force F2*c* of the second compression coil spring 74 is applied thereto.

On the other hand, in the jam elimination mode, when the pressurizing rocking support frames 71 and 72 of the pressing mechanism 7 are in a state of being prevented from being rocked to the side becoming close to the heating roll 51 (in the direction indicated by arrow C), the cams 81 are set in a state of not exerting a force for rocking the second rocking support frames 85 in a direction of moving the second rocking support frames 85 close to the heating roll 51. Furthermore, since the distance K3 between the third cam face 81*c* and the cam rotation shaft 83 is set to a value smaller than that in the envelope mode, the second rocking support frames 85 are further rocked in the direction indicated by arrow H in comparison with the case of the envelope mode. Hence, the pressing body 62 (both the head member 64 and the pad member 65 thereof) is moved slightly away from the surface of the heating roll 51 and a clearance may be generated therebetween.

As described above, in the jam elimination mode, the pressure applied from the pressing mechanism 7 to the pressing body 62 does not exceed a predetermined value, and the pressing body 62 may be displaced in a state in which a clearance is generated between the pressing body 62 and the heating roll 51.

Consequently, in the jam elimination mode, even if the recording medium 10 to be subjected to fixing is jammed at the pressure-contact portion NP, when the user holds part of the recording medium 10 and pulls the recording medium toward the discharging side, the second rocking support frames 85 are rocked slightly in the direction indicated by arrow H, and the pressing body 62 results in a state of being slightly away from the heating roll 51. Hence, the jammed recording medium 10 is pulled out relatively easily from the pressure-contact portion NP and eliminated. In this way, the operation for eliminating the jammed recording medium 10 is performed.

The pressure (distribution) applied to the pressure-contact portion NP of the heating roll 51 in the jam elimination mode is a very low pressure close to zero to such an extent that the pressure is obtained using the pad member 65 slightly making contact with the heating roll 51. For reference's sake, since the pressurizing rocking support frames 71 and 72, having been struck as described above, are not further rocked in a direction of becoming close to the heating roll 51 at this time, pressure that is applied to the heating roll 51 by the further rocking of the pressurizing rocking support frames 71 and 72 is not generated.

Second Exemplary Embodiment

Figure 12:
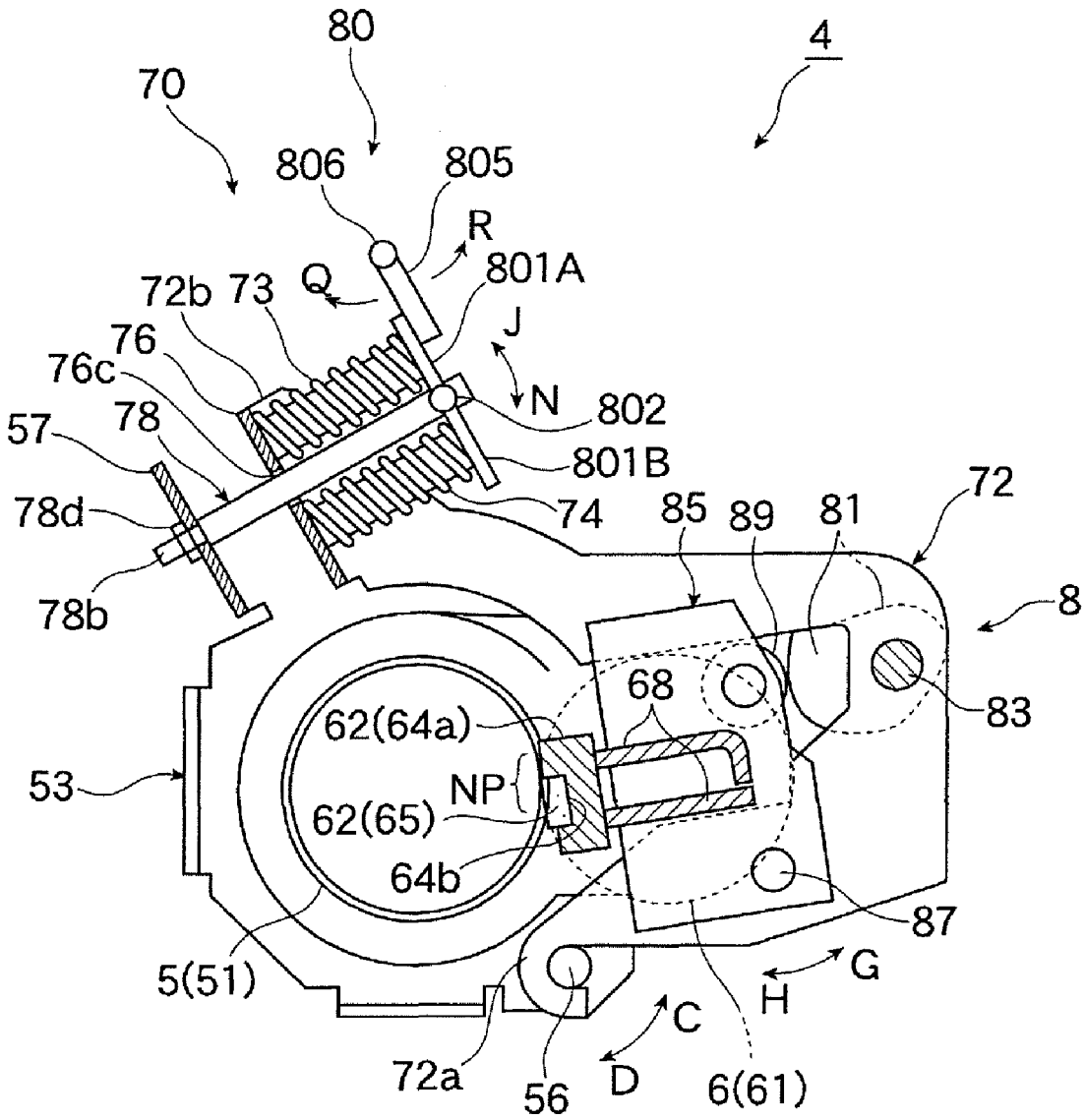
FIG. 12 is a partially sectional explanatory view showing the main portions of a fixing device according to a second exemplary embodiment.

This exemplary embodiment is configured such that a switching mechanism 80 for switching the total compression amount of the two compression coil springs 73 and 74 to plural of states (three in this exemplary embodiment) is added to the switching mechanism 8 in the fixing device 4 (the image forming device 1) according to the first exemplary embodiment as shown in FIG. 12, etc. The same components as those in the first exemplary embodiment are designated by the same numerals in FIG. 12, etc., and the descriptions of the components are omitted unless other wise necessary (this is similarly applicable to the following exemplary embodiments).

The switching mechanism 80 has a compression changing mechanism 810 for switching the total compression amount of the two compression coil springs 73 and 74 disposed side by side on the spring pressing face portions 75 and 76 of the pressurizing rocking support frames 71 and 72 in the pressing mechanism 7 to a predetermined compression amount, i.e., a first compression state, or a compression amount smaller than the predetermined compression amount, i.e., a second compression state, and for maintaining the state. The first compression state corresponds to the state used in the above-mentioned normal mode, and the second compression state corresponds to the state used in the above-mentioned envelope mode.

The compression changing mechanism 810 is installed in the upper portion of a column 78 disposed between the two compression coil springs 73 and 74 and comprises a compression adjusting plate 801 making contact with the one end portions of the compression coil springs 73 and 74 at the same time and displaced in directions of compressing and extending the springs; and a restricting member 805 for performing restriction at positions corresponding to the first compression state and the second compression state in which the displacement of the compression adjusting plate 801 is maintained.

The compression adjusting plate 801 is configured so as to have a size and a shape capable of making contact with the one end portions of the two compression coil springs 73 and 74 at the same time. The compression adjusting plate 801 is rotatably installed via a fulcrum shaft 802 disposed at the upper portion of the column 78 in the nearly central portion thereof and is rocked in the directions indicated by arrows J and N with the fulcrum shaft 802 being used as a fulcrum. The main body of the column 78 on which the compression adjusting plate 801 is installed is passed through each of the through holes 75*c* and 76*c* of the spring pressing face portions 75 and 76. Furthermore, the threaded portion 78*b* of the lower portion of the main body is fitted into an installing hole formed in the spring support face portion 57 of the heating support frame 53, and the threaded portion 78*b* is tightened with a nut 78*d* to secure the column to the spring support face portion 57.

The restricting member 805 is configured so as to be movable to stop the compression adjusting plate 801 at a predetermined position in a state of making contact with part of the compression adjusting plate 801 or in a state of not making contact with the compression adjusting plate 801 when the compression adjusting plate 801 is rocked. In this exemplary embodiment, the restricting member 805 is installed in a state of being rocked in the directions indicated by arrows Q and R around a support shaft 806 disposed near one end portion of the adjusting plate 801 so as to be movable to positions of making contact with and not making contact with the compression adjusting plate 801. The support shaft 806 is provided in a predetermined securing member, and for example, provided in the housing 40 of the fixing device 4.

The compression changing mechanism 810 is installed in a state in which the two compression coil springs 73 and 74 are held between the compression adjusting plate 801 and each of the spring pressing face portions 75 and 76, and both the compression coil springs 73 and 74 are installed so as to be maintained in a compressed state at all times (regardless of any difference in compression amount) at each rocking position of the compression adjusting plate 801 when the compression adjusting plate 801 is restricted using the restricting member 805. As in the case of the first exemplary embodiment, the compression coil springs 73 and 74 are formed of a first compression coil spring 73 having a large spring constant and a second compression coil spring 74 having a spring constant smaller than that of the first compression coil spring 73. However, their free lengths L1 and L2 are different from each other (for example, L1<L2).

In this exemplary embodiment, the restricting member 805 is set so as to be rocked and movable to a first restricting position (shown in FIGS. 12 and 13) in which the above-mentioned first compression state is obtained and to a second restricting position (shown in FIG. 14) in which the above-mentioned second compression state is obtained. The first restricting position is a securing position when the distances W1 and W2 between the portions 801A and 801B of the compression adjusting plate 801 making contact with the compression coil springs 73 and 74 and each of the spring pressing face portions 75 and 76 are maintained at "W1*a* and W2*a*" serving as the "reference setting lengths in the normal mode". The second restricting position is a position in which the restricting member 805 is withdrawn so as not to make contact with the compression adjusting plate 801 or a position in which the restricting member 805 is in an unsecured sate (in a state of being rockable). When the restricting member 805 is located at the first restricting position, the restricting member 805 is disposed so as to make contact with part of the compression adjusting plate 801 so that restricting member 805 may make contact with the rocking position (attitude) of the compression adjusting plate 801 and restrict the adjusting plate 801. Furthermore, the restricting member 805 is rocked and moved to the first restricting position and the second restricting position by operating displacement driving unit, such as a solenoid (not shown).

When the restricting member 805 is located at the second restricting position, the above-mentioned distances W1 and W2 become distances W1*b* and W2*b* that are obtained when the compression adjusting plate 801 is released from the restricting member 805 and rocked until the forces of the two compression coil springs are balanced. The actual values of the distances W1*b* and W2*b* in this exemplary embodiment are amounts obtained when the compression adjusting plate 801 is rocked plus amounts (E1*b*−E1*a* and E2*b*−E2*a*) obtained when the distances E1 and E2 (see FIGS. 8 and 9) between the compression adjusting plate 801 and each of the spring pressing face portions 75 and 76 are changed after each of the pressurizing rocking support frames 71 and 72 is rocked by the rotation of the cam 81 of the switching mechanism 8, as in the case of the first exemplary embodiment.

When the restricting member 805 is located at the first restricting position, the compression amount P1*a* of the first compression coil spring 73 becomes "P1*a*=L1−W1*a*" and the compression amount P2*a* of the second compression coil spring 74 becomes "P2*a*=L2−W2*a*". Furthermore, the total compression amount PXa of the two compression coil springs at this time becomes "PXa=P1*a*+P2*a*".

On the other hand, when the restricting member 805 is located at the second restricting position, the compression amount P1*b* of the first compression coil spring 73 becomes "P1*b*=L1−W1*b*" and the compression amount P2*b* of the second compression coil spring 74 becomes "P2*b*=L2−W2*b*". Furthermore, the total compression amount PXb of the two compression coil springs at this time becomes "PXb=P1*b*+P2*b*".

In addition, the compression changing mechanism 810 sets the spring constants, free lengths, reference setting lengths (W1*a* and W2*a*) of the compression coil springs 73 and 74, the position of the compression adjusting plate 801, etc. so that the total compression amount PXb of the compression coil springs 73 and 74 when the restricting member 805 is located at the second restricting position becomes a compression amount smaller than the total compression amount PXa when the restricting member 805 is located at the first restricting position.

Next, the operation of the fixing device 4 will be described below.

Figure 13:
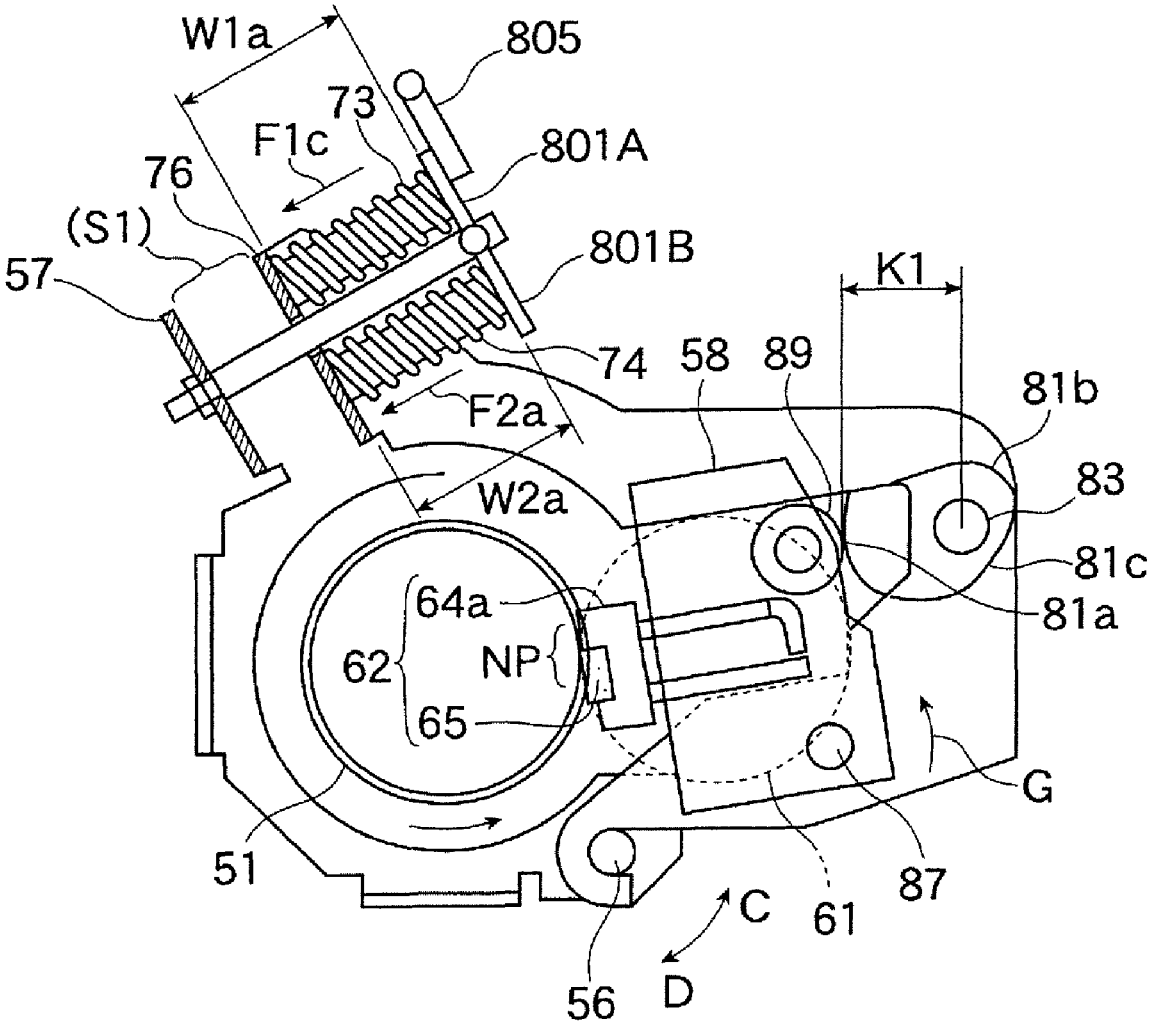
FIG. 13 is an explanatory view showing a state in the normal mode of the fixing device shown in FIG. 12.

In the normal mode, as shown in FIG. 13, the cam 81 of the switching mechanism 8 is made contact with the cam receiver 89 at the first cam face 81*a* as in the case of the first exemplary embodiment, and the restricting member 805 of the switching mechanism 80 is moved to the first restricting position and secured.

Since the first cam face 81*a* of the cam 81 makes contact with the cam receiver 89 at this time, as in the case of the first exemplary embodiment, the pressurizing rocking support frames 71 and 72 are rocked so as to be away from the heating roll 51 in the direction indicated by arrow D, and the spring pressing face portions 75 and 76 are moved in a direction of becoming away from the spring support face portions 57 and maintained at a position spaced by the predetermined distance (S1). In addition, by the movement of the restricting member 805 to the first restricting position, the compression adjusting plate 801 is rocked to a position conforming to the first restricting position and maintained in a restricted state.

By the operation of the switching mechanisms 8 and 80, in the pressing mechanism 7, the two compression coil springs 73 and 74 are compressed, while being held between the compression adjusting plate 801 and each of the spring pressing face portions 75 and 76, so that the distances W1 and W2 between the portions 801A and 801B of the compression adjusting plate 801 and each of the spring pressing face portions 75 and 76 become the reference setting distances (W1*a* and W2*a*) for the normal mode. The reference setting distances W1*a* and W2*a* are set to values smaller than the free length L1 of the first compression coil spring 73 and the free length L2 of the second compression coil spring 74. As a result, the two compression coil springs 73 and 74 are maintained at a compressed state so that the total compression amount thereof (P1+P2) becomes the compression amount PX1 for the normal mode. The state of the springs may be assumed to be a state due to the effect of the parallel connection of the spring constants of the two springs 73 and 74 (this is the "first compression state"). The whole compression amount PXa of the combination of the compression coil springs at this time becomes "PXa=P1*a*+P2*a*" as described above.

Hence, in the normal mode, as in the case that the first compression coil spring 73 and the second compression coil spring 74 are connected in parallel, the compression coil springs exert forces F1*c* and F2*c* (=compression amount× spring constant) depending on the compression amounts (P1*a* and P2*a*) and the spring constants thereof and continuously press each of the spring pressing face portions 75 and 76 by the spring forces F1*c* and F2*c* in a direction of moving each of the spring pressing face portions 75 and 76 close to the spring support face portion 57. As a result, the pressurizing rocking support frames 71 and 72 are maintained in a state of being rocked to the side becoming close to the heating roll 51 (in the direction indicated by arrow C).

As a result, as in the case of the normal mode in the first exemplary embodiment, the pressurizing rocking support frames 71 and 72 press the second rocking support frames 85 via the cams 81 and the cam receivers 89 in a direction of moving the second rocking support frames 85 close to the heating roll 51, whereby the pressing body 62 supported on the rocking support frames 85 is pressed against the heating roll 51 by the high pressure X required during fixing in the normal mode.

Furthermore, in the normal mode, since the pressurizing rocking support frames 71 and 72 of the pressing mechanism 7 are maintained in a state of being rocked in a direction of moving the second rocking support frames 85 close to the heating roll 51, both (the protruding portion 64*a* of) the head member 64 and the pad member 65 of the pressing body 62 supported on the second rocking support frames 85 are maintained in a state of being pressed against the heating roll 51.

Figure 14:
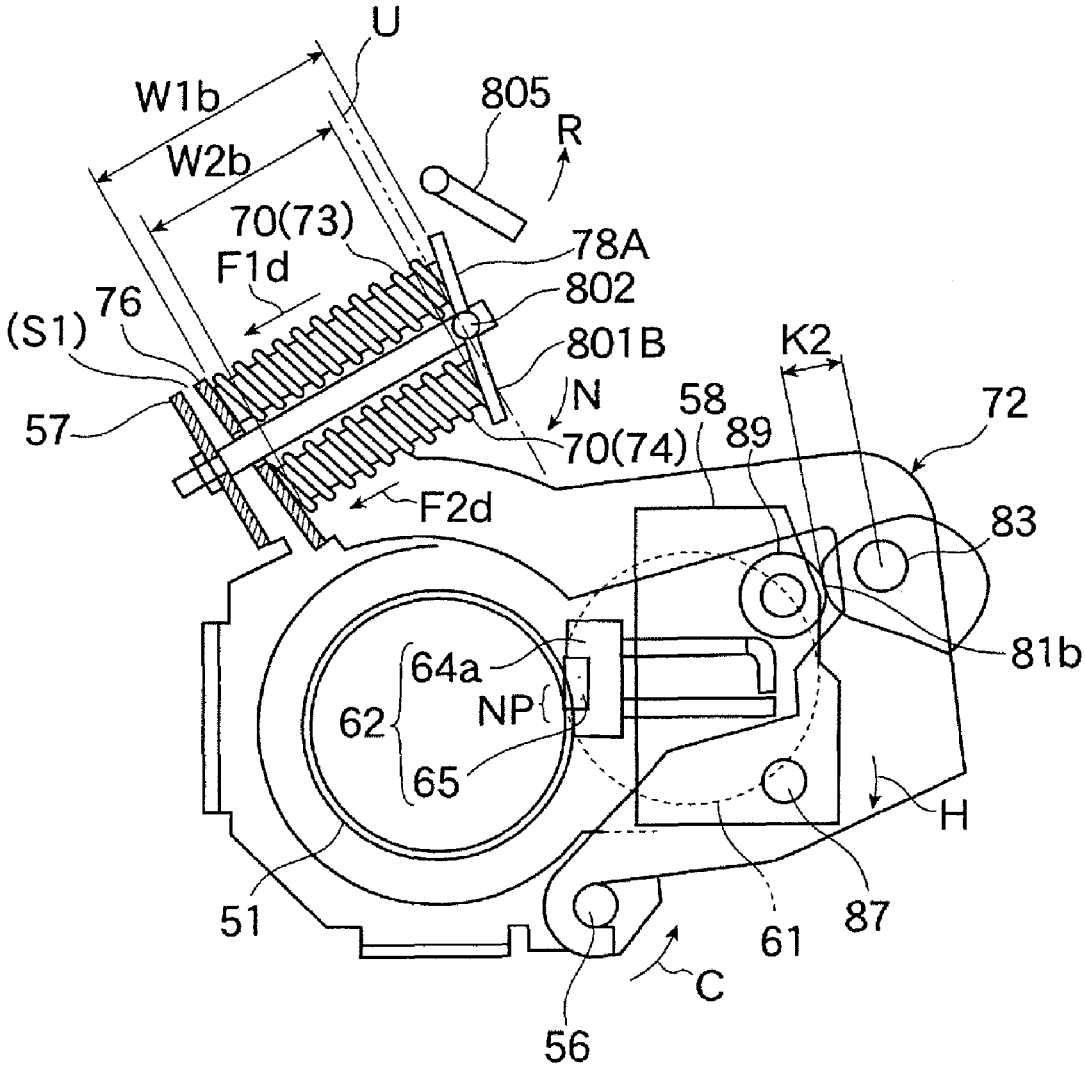
FIG. 14 is an explanatory view showing a state in the envelope mode of the fixing device shown in FIG. 12.

Next, in the envelope mode, as shown in FIG. 14, the cam 81 of the switching mechanism 8 is made contact with the cam receiver 89 at the second cam face 81*b* as in the case of the first exemplary embodiment, and the restricting member 805 of the switching mechanism 80 is moved to the second restricting position and secured.

Since the second cam face 81*b* of the cam 81 makes contact with the cam receiver 89 at this time, as in the case of the first exemplary embodiment, the pressurizing rocking support frames 71 and 72 are rocked so as to be close to the heating roll 51 in the direction indicated by arrow C, and the spring pressing face portions 75 and 76 are moved in a direction of becoming close to the spring support face portions 57 and maintained at a position spaced by the predetermined distance (S2). In addition, by the movement of the restricting member 805 to the second restricting position, the compression adjusting plate 801 is rocked to a position conforming to the second restricting position and maintained in a restricted state.

By the operation of the switching mechanisms 8 and 80, in the pressing mechanism 7, the two compression coil springs becomes 73 and 74 are held between each of the spring pressing face portions 75 and 76 having been rocked in a direction of becoming close to the spring support face portion 57 and the compression adjusting plate 801 that is released from the restricting member 805 and rocked to a balanced position by the spring forces of the compression coil springs 73 and 74.

At this time, since the compression coil spring having a relatively larger spring force (the first compression coil spring 73 in this example) extends, the compression adjusting plate 801 is rocked wholly around the fulcrum shaft 802 and inclined in the direction indicated by arrow N. The alternate long and two short dashed line U in FIG. 14 indicates a face (position) in which the compression adjusting plate 801 makes contact with the springs in the normal mode. Furthermore, since the compression adjusting plate 801 is rocked at this time, the second compression coil spring 74 is pressed in a direction of being compressed using the compression adjusting plate 801. However, each of the spring pressing face portions 75 and 76 is moved in a direction of becoming close to the spring support face portion 57 as described above, thereby being moved in a direction of becoming away from the compression adjusting plate 801. As a result, the second compression coil spring 74 is in a state of extending slightly. Hence, the two compression coil springs 73 and 74 may be assumed to be a single combined spring (70) in which the two compression coil springs are connected in series via the compression adjusting plate 801. The state of the spring may be assumed to be a state due to the effect of the series connection of the spring constants of the two springs 73 and 74.

As a result, the distances W1 and W2 between the portions 801A and 801B of the compression adjusting plate 801 and each of the spring pressing face portions 75 and 76 become the distances (W1*b* and W2*b*) for the envelope mode, whereby the two compression coil springs 73 and 74 held between the compression adjusting plate 801 and both the spring pressing face portions 75 and 76 become an extending state. Distances W1*b* and W2*b* for the envelope mode are herein set to values larger than the reference setting distances W1*a* and W2*a* for the normal mode. As a result, the two compression coil springs 73 and 74 are maintained in a compressed state m which the total compression amount (P1+P2) thereof becomes the compression amount PXb for the envelope mode. The state of the springs may be assumed to be a state due to the effect of the series connection of the spring constants of the two springs 73 and 74 (this is the "first compression state"). The whole compression amount PXb of the combination of the compression coil springs at this time becomes "PXb=P1*b*+P2*b*" as described above.

Hence, in the envelope mode, the first compression coil spring 73 and the second compression coil spring 74 exert spring forces F1*d* and F2*d* depending on the total of the respective compression amounts thereof (P1*a*+P2*a*) and the combined spring constant [$\alpha 1 \times \alpha 2/(\alpha 1+\alpha 2)$] in the case of series connection, wherein $\alpha 1$ is the spring constant of the first compression coil spring 73 and $\alpha 2$ is the spring constant of the second compression coil spring 74. The compression coil springs 73 and 74 continuously press each of the spring pressing face portions 75 and 76 in a direction of moving each of the spring pressing face portions 75 and 76 close to the spring support face portion 57 by the spring forces F1*d* and F2*d* obtained at this time. As a result, the pressurizing rocking support frames 71 and 72 are maintained in a state of being rocked to the side becoming close to the heating roll 51 (in the direction indicated by arrow C). The total value of the spring forces (F1*d* and F2*d*) at this time becomes smaller than the total value of the spring forces (F1*a* and F2*a*) exerted in the normal mode.

As a result, in the envelope mode, although the pressurizing rocking support frames 71 and 72 press the second rocking support frames 85 in a direction of moving the second rocking support frames 85 close to the heating roll 51 as in the case of the normal mode, since the total value of the spring forces F1*d* and F2*d* in the pressing mechanism 7 is smaller than the total value of the spring forces (F1*a* and F2*a*) exerted in the normal mode, the force transmitted to the cam 81 becomes weaker than that in the normal mode. Hence, the pressing body 62 supported on the rocking support frames 85 is pressed against the heating roll 51 by pressure Y (<X) lower than the high pressure X required during fixing in the normal mode.

Furthermore, even in the envelope mode, as in the case of the normal mode, the pressurizing rocking support frames 71 and 72 of the pressing mechanism 7 maintain the second rocking support frames 85 in a rocked state in a direction of moving the second rocking support frames 85 close to the heating roll 51 via the cams 81.

However, in this case, since the total value of the spring forces F1*d* and F2*d* in the pressing mechanism 7 is smaller than the total value of the spring forces (F1*a* and F2*a*) exerted in the normal mode, the force of the pressurizing rocking support frames 71 and 72 pressing the second rocking support frames 85 is weaker than that in the normal mode, and the force of the pressing body 62 pressing the heating roll 51 is also weak. Hence, the pressing body 62 receives, for example, a force generated by the friction between the heating roll 51 rotating in the direction indicated by arrow A and the endless belt 61 being driven and rotated. Consequently, the second rocking support frames 85 are maintained in a state of being rocked in the direction indicated by arrow H with the second support shaft 87 being used as a fulcrum.

As a result, as in the case of the envelope mode in the first exemplary embodiment, the state of pressing the heating roll 51 becomes as described below (changed). That is, (the protruding portion 64*a*) of the head member 64 of the pressing body 62 is moved in a direction of becoming away from the heating roll 51 and is set in a state of not pressing the heating roll 51. On the other hand, only the pad member 65 thereof is moved to a position opposed to the heating roll 51 and is set in a state of pressing the endless belt 61 against the heating roll 51.

Furthermore, also in the envelope mode, nearly as in the case of the envelope mode in the first exemplary embodiment, the fixing for the envelop-shaped recording medium 10 is performed under an environment in which the pressure is lower than that in the normal mode, the pressure-contact portion NP is elastically deformed depending on the passing state of the recording medium 10, and the pressurizing rocking support frames 71 and 72 are rocked by a necessary amount with respect to the heating support frame 53 and balanced mutually (dynamically) depending on the passing state of the recording medium. In addition, in the envelope mode, the compression coil springs 73 and 74 of the pressing mechanism 7 are not further compressed forcibly unlike the case of the normal mode. For this reason, the compression coil springs 73 and 74 are free from shrinkage and sagging that may occur if there is a period during which the springs are set in a forcibly compressed state.

Hence, even in the fixing device 4 according to this exemplary embodiment, when the envelope mode is selected and the envelop-shaped recording medium 10 is subjected to fixing, as in the case of the fixing in the envelope mode in the first exemplary embodiment, no wrinkles occur on the recording medium 10 (in its rear region in the conveying direction in particular), and stable and favorable fixing is made possible.

Next, in the case of the jam elimination mode, in the fixing device 4, the cam 81 of the switching mechanism 8 is made contact with the cam receiver 89 at the third cam face 81*c* thereof (see FIG. 10) as in the case of the first exemplary embodiment.

Hence, as in the case of the jam elimination mode in the first exemplary embodiment, the pressurizing rocking support frames 71 and 72 are rocked in the direction indicated by arrow C so as to become close to the heating roll 51, and the spring pressing face portions 75 and 76 of the pressurizing rocking support frames 71 and 72 are struck against the spring support face portions 57 of the heating support frames 53. At this time, the two compression coil springs 73 and 74 in the pressing mechanism 7 are in a state of extending by the amount corresponding to the rocking of each of the pressurizing rocking support frames 71 and 72 in the direction indicated by arrow C but do not extend beyond their free lengths. Consequently, the recording medium 10 held and jammed at the pressure-contact portion NP of the fixing device 4 may be pulled out easily from the pressure-contact portion NP and eliminated by selecting the jam elimination mode.

Third Exemplary Embodiment

Figure 15:
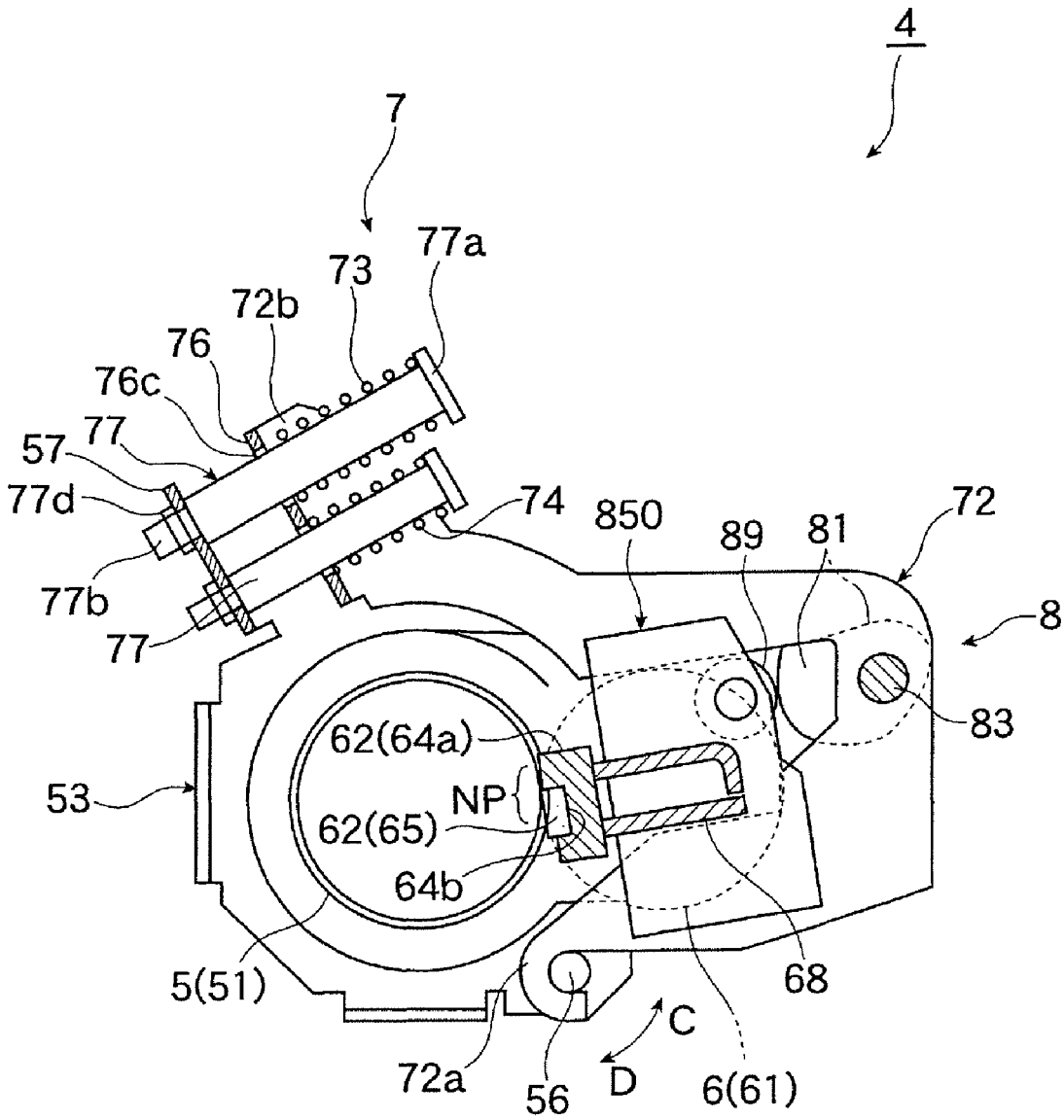
FIG. 15 is a partially sectional explanatory view showing the main portions of a fixing device according to a third exemplary embodiment.

A fixing device 4 according to a third exemplary embodiment uses stationary support frames 850 instead of the second rocking support frames 85 used in the fixing device according to the first exemplary embodiment as shown in FIG. 15.

The stationary support frames 850, supporting the pressing support members 63 of the pressing body 62 as in the case of the second rocking support frames 85, are installed so as to be secured at predetermined positions on the pressurizing rocking support frames 71 and 72. The stationary support frame 850 is provided with the cam receiver 89. Unlike the pressing body 62 of the fixing device 4 according to the first exemplary embodiment, the pressing body 62 installed on the stationary support frames 850 is not displaced significantly to the recording medium introduction side and the recording medium discharging side at the pressure-contact portion NP when the support frames are rocked. In addition, in the case that the stationary support frames 850 are used, after the pressing body 62 has made contact with the heating roll 51 so as to press the surface thereof via the endless belt 61, the pressurizing rocking support frames 71 and 72 are not rocked further in a direction of becoming close to the heating roll 51 (in the direction indicated by arrow C).

In this fixing device 4, as in the case of the first exemplary embodiment, etc., when the cam 81 of the switching mechanism 8 is rotated and one of the three cam faces thereof is made contact with the cam receiver 89, the setting of the switching mechanism 8 is switched to the first pressing state and the second pressing state of the pressing mechanism 7 and the striking state of the spring pressing face portions 75 and 76. As a result, the setting is performed (changed) to the states corresponding to the normal mode, the envelope mode and the jam elimination mode. In particular, in the envelope mode, the pressing mechanism 7 becomes the second pressing state, and the force of the pressing body 62 pressing the heating roll 51 becomes smaller than that in the normal mode, whereby the envelop-shaped recording medium 10 may also be subjected to fixing while wrinkle generation is suppressed.

In this exemplary embodiment, for the purpose of, for example, avoiding a state in which the pressing body 62 is displaced together with the rocking of the pressurizing rocking support frames 71 and 72 and the pressing portion of the pressing body 62 at the pressure-contact portion NP is changed unexpectedly, it is possible to adopt, for example, a configuration in which the distance between each of the spring pressing face portions 75 and 76 and the spring support face portion 57 is set to a small value or a configuration in which the pressing mechanism 7 is disposed on the recording medium introduction side of the pressure-contact portion NP (the first support shafts 56 are disposed on the recording medium discharging side thereof).

Fourth Exemplary Embodiment

Figure 16:
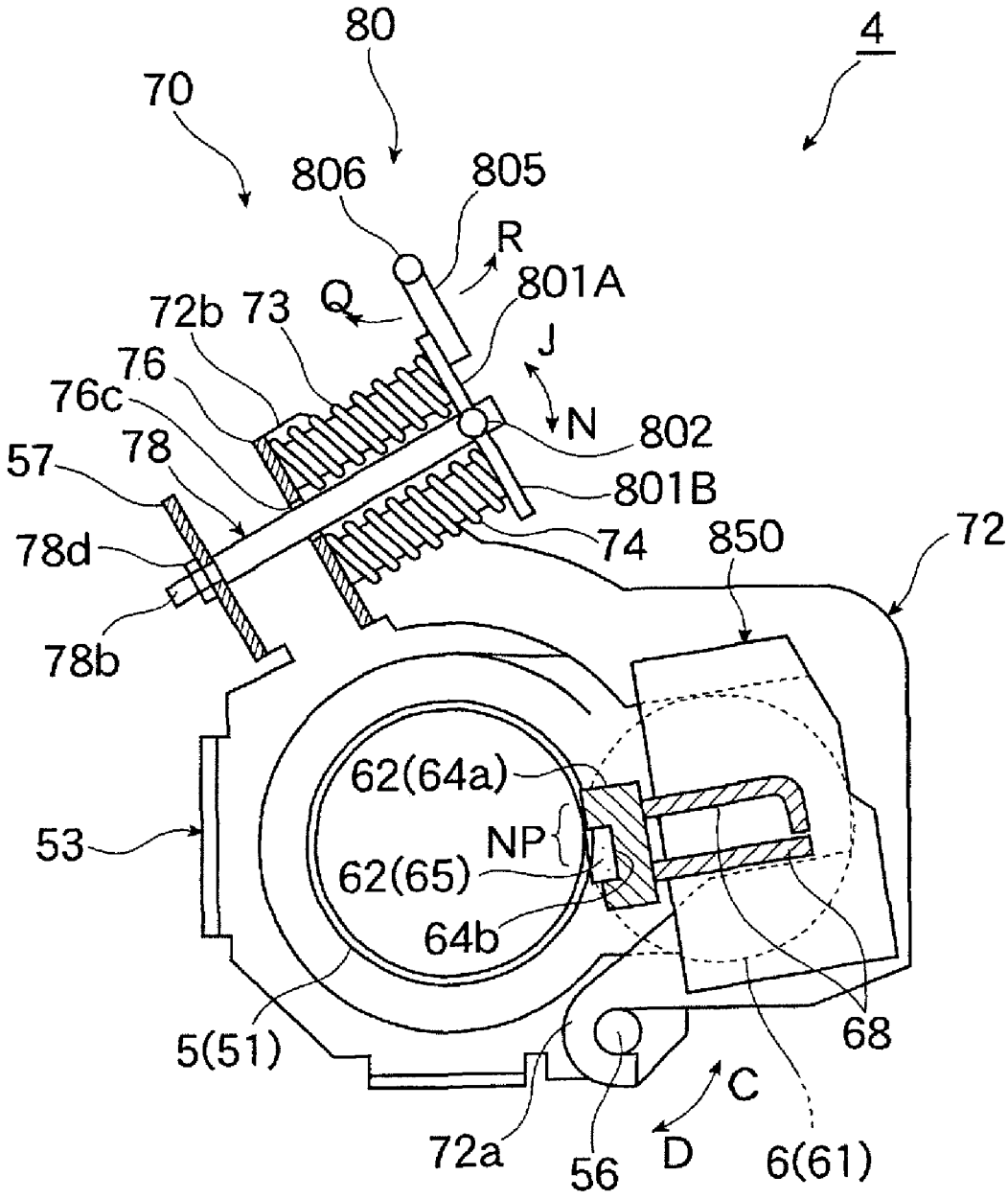
FIG. 16 is a partially sectional explanatory view showing the main portions of a fixing device according to a fourth exemplary embodiment.

A fixing device 4 according to a fourth exemplary embodiment uses the stationary support frames 850 instead of the second rocking support frames 85 used in the fixing device according to the second exemplary embodiment as shown in FIG. 16 as in the case of the third exemplary embodiment. Furthermore, in this fixing device 4, the installation of the switching mechanism 8 is omitted because the stationary support frames 850 are used.

In the fixing device 4, in the case that the restricting member 805 of the switching mechanism 80 is secured to the first restricting position, the two compression coil springs 73 and 74 of the pressing mechanism 7 are held between the compression adjusting plate 801, the position of which is restricted using the restricting member 805, and each of the spring pressing face portions 75 and 76, and maintained at the first compression state. Furthermore, in the case that the restricting member 805 of the switching mechanism 80 is moved to the second restricting position, the two compression coil springs 73 and 74 of the pressing mechanism 7 are held between the compression adjusting plate 801, which is released from the restricting member 805 and pressed and rocked by the spring force of the compression coil spring having a larger spring force, and each of the spring pressing face portions 75 and 76, thereby being maintained in the second compression state. In the second compression state, the compression coil spring having a larger spring force is in an extending state.

Furthermore, in the fixing device 4, when the restricting member 805 of the switching mechanism 80 is moved to the first restricting position or the second restricting position, nearly as in the case of the second exemplary embodiment, the setting of the pressing mechanism 7 is switched to the first compression state or the second compression state. As a result, the setting may be performed (changed) to the states corresponding to the normal mode and the envelope mode. In particular, in the envelope mode, the pressing mechanism 7 becomes the second compression state, and the force of the pressing body 62 pressing the heating roll 51 becomes smaller than that in the normal mode, whereby the envelop-shaped recording medium 10 may also be subjected to fixing while wrinkle generation is suppressed. Moreover, since the installation of the switching mechanism 8 is not required in the fixing device 4, it is not necessary to obtain installation space for the switching mechanism, whereby the device may be made compact and simple.

Even in this exemplary embodiment, it is also possible to adopt such a favorable configuration as described in the third exemplary embodiment.

Fifth Exemplary Embodiment

Figure 17:
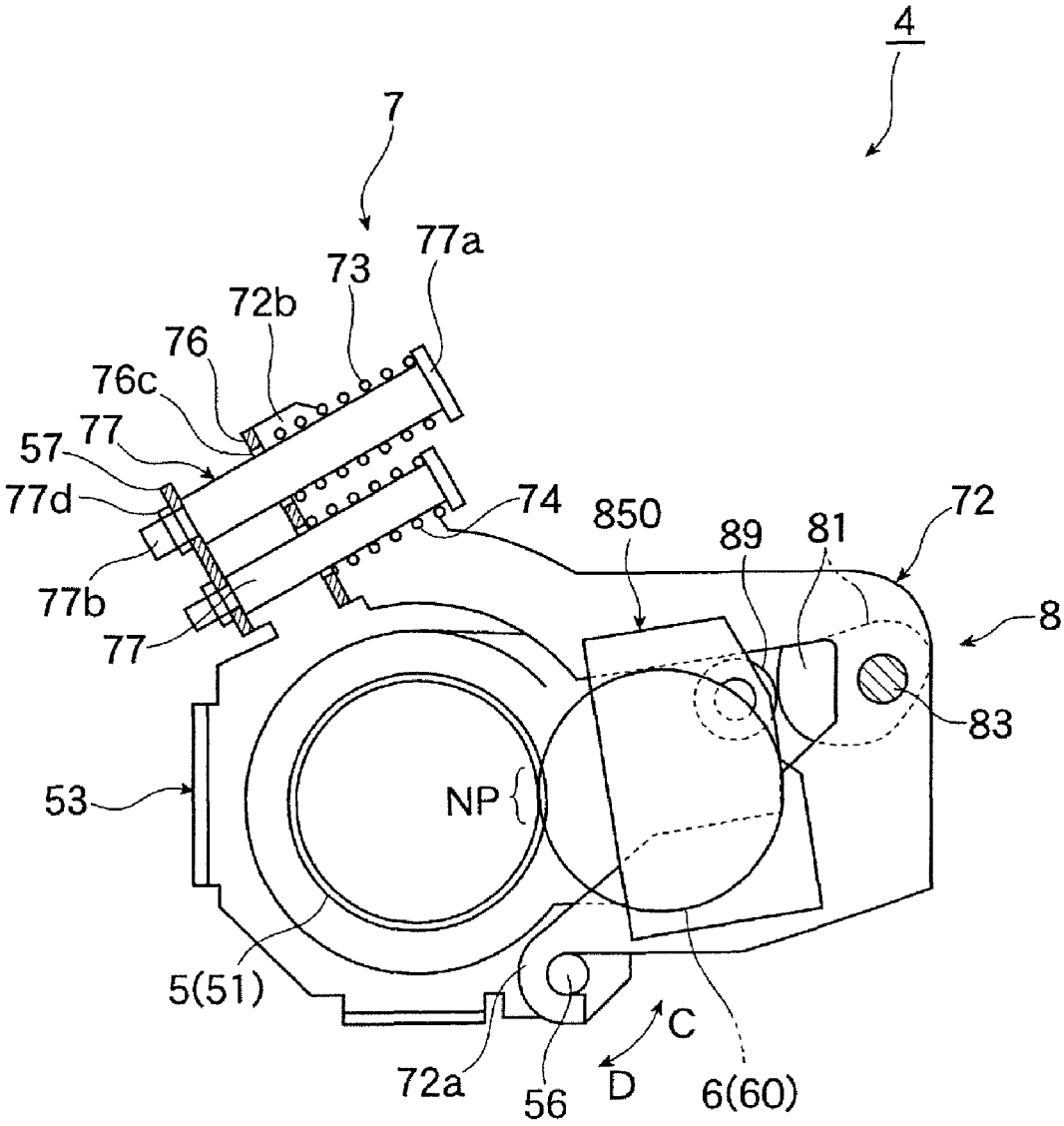
FIG. 17 is a partially sectional explanatory view showing the main portions of a fixing device according to a fifth exemplary embodiment.

A fixing device 4 according to a fifth exemplary embodiment uses a roll-shaped pressurizing rotating body 60 (pressurizing roll) instead of the belt-shaped pressurizing rotating body 6 used in the fixing device according to the first exemplary embodiment and also uses the stationary support frames 850 instead of the second rocking support frames 85 as support frames for supporting the pressurizing rotating body 60 as shown in FIG. 17.

The pressurizing roll 60 comprises a roll substrate made of metal or the like and function layers, such as an elastic layer and a releasing layer, formed on the surface of the substrate as necessary. The pressurizing roll 60 is rotatably supported on the stationary support frames 850 at both end portions thereof. The stationary support frame 850 is installed in a state of being secured to a predetermined position on each of the pressurizing rocking support frames 71 and 72. Furthermore, the stationary support frame 850 is provided with the cam receiver 89. The pressurizing roll 60 receives the spring force generated in the pressing mechanism 7 via the pressurizing rocking support frames 71 and 72, the cams 81, the cam receivers 89 and the stationary support frames 850, thereby making contact with the surface of the heating roll 51 at a predetermined pressure and forming the pressure-contact portion NP.

In this fixing device 4, as in the case of the first exemplary embodiment, when the cam 81 of the switching mechanism 8 is rotated and one of the three cam faces thereof is made contact with the cam receiver 89, the setting of the switching mechanism 8 is switched to the first pressing state and the second pressing state of the pressing mechanism 7 and the striking state of the spring pressing face portions 75 and 76. As a result, the setting is performed (changed) to the states corresponding to the normal mode, the envelope mode and the jam elimination mode. In particular, in the envelope mode, the pressing mechanism 7 becomes the second pressing state, and the force of the pressurizing roll 60 pressing the heating roll 51 becomes smaller than that in the normal mode, whereby the envelop-shaped recording medium 10 may also be subjected to fixing while wrinkle generation is suppressed.

Other Exemplary Embodiments

In the first to fifth exemplary embodiments, three or more compression coil springs may be used for the pressing mechanism 7. In addition, it is also possible to use leaf-shaped compression springs instead of the compression coil springs. The conditions, such as spring constants, free lengths and compressed lengths, of the plural compression coil springs used in the pressing mechanism 7 may be changed as necessary. Furthermore, the pressing mechanism 7 may also be configured using springs, such as tension springs.

Moreover, for the switching mechanism 8 for performing switching between the first pressing state and the second pressing state, a mechanism other than the cam (mechanism) may also be used, provided that the mechanism is a rocking maintaining mechanism capable of rocking the pressurizing rocking support frames 71 and 72 to a predetermined position and maintaining them at the position. The switching mechanism 8 may also be configured such that the cam 81 is rotated, for example, using a rotation drive unit instead of the operation of the lever 84.

Still further, for the switching mechanism 80 for performing switching between the first compression state and the second compression state, the mechanism may be combined with a maintaining mechanism capable of rocking the compression adjusting plate 801 to a predetermined angle and maintaining it at the angle, instead of using the restricting member 805.

Yet still further, as the imaging device 2 in the image forming device 1, it may also be possible to use a multicolor imaging device capable of forming multicolor toner images and transferring the images to respective pieces of the recording medium 10. As the transfer system for the imaging device 2, it may also be possible to adopt the known intermediate transfer system or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device comprising:

a heating rotating body that is heated by a heater and rotates about a first rotation shaft;

a pressurizing rotating body that is in contact with a surface portion of the heating rotating body extending along a direction of the first rotation shaft and rotates about a second rotation shaft, and that forms a fixing portion through which a recording medium carrying an unfixed image is passed;

a pressing mechanism that presses the pressurizing rotating body against the heating rotating body and that uses a plurality of springs disposed on both end portions of the pressurizing rotating body in a direction of the second rotation shaft; and a switching mechanism that switches between a first pressing state in which first combination of springs selected from among the plurality of springs in the pressing mechanism are maintained so that a pressure of the first combination is exerted and a second pressing state in which second combination of springs selected from among the plurality of springs except the first combination of the springs are maintained so that a pressure of the second combination is exerted.

2. The fixing device according to claim 1, wherein the switching mechanism switches to a third pressing state in which the plurality of springs in the pressing mechanism are maintained so that a pressure of the plurality of springs is not exerted to the pressurizing rotating body.

3. The fixing device according to claim 1, wherein the pressing mechanism includes a pair of first rocking support members that supports both end portions of the pressurizing rotating body and rocks so as to become close to and away from the pressurizing rotating body while a part of each of the first rocking support members on a recording medium introduction side of the fixing portion is attached on a stationary support member via a first shaft, and the plurality of springs that are attached so as to press a region of each of the first rocking support members on a rocking free end thereof so that each of the first rocking support members are rocked to be close to the heating rotating body, and that are disposed at positions having different distances from the first shaft, and the switching mechanism includes a rocking and maintaining mechanism that rocks and maintains each of the first rocking support members so that all of the plurality of springs are set to a compressed state when the switching mechanism is set to the first pressing state, and at least one of the plurality of springs disposed at a position away from the first shaft is set to have a free length thereof when the switching mechanism is set to the second pressing state.

4. The fixing device according to claim 3, wherein the switching mechanism switches among the first to third pressing states, and when the switching mechanism is set to the third pressing state, the switching mechanism rocks each of the first rocking support members of the pressing mechanism using the rocking and maintaining mechanism of the switching mechanism so that each of the first rocking support members abuts against the stationary support member to maintain that rocking of each of the first rocking support members to a side becoming close to the heating rotating body is stopped.

5. The fixing device according to claim 3, wherein the pressurizing rotating body includes:

an endless belt that is in contact with the surface portion of the heating rotating body extending along the first rotation shaft and rotates;

a pressing body that has an elastic pressing portion and a non-elastic pressing portion and that forms the fixing portion to press the endless belt against the surface portion of the heating rotating body from an inner circumferential face side of the endless belt; and a pressing support member that rotatably supports the endless belt and supports the pressing body, the fixing device further comprising:

a pair of second rocking support members that supports the pressing support members of the pressurizing rotating body and rocks while attached on the pair of first rocking support members of the pressing mechanism via a second shaft so that a portion of the pressing body, which is used to press the endless belt against the heating rotating body, is changed between the elastic pressing portion and the non-elastic pressing portion, wherein the rocking and maintaining mechanism of the switching mechanism is rotatably attached on each of the first rocking support members of the pressing mechanism and disposed in a state of being in contact with each of the second rocking support members and rocking each of the second rocking support members in a direction of moving the pressing body to be close to the heating rotating body, and the rocking and maintaining mechanism includes cams that rocks and maintain the first rocking support members between a position of the first pressing state and a position of the second pressing state, and, at the same time, rock and maintain the second rocking support members to a position in which the portion of the pressing body is changed between the elastic pressing portion and the non-elastic pressing portion.

6. The fixing device according to claim 5, wherein the cams of the switching mechanism rock and maintain the pair of first rocking support members to the position of the second pressing state and, at the same time, rocks and maintains the pair of the second rocking support members to a state in which only the elastic pressing portion of the pressing body presses the endless belt.

7. The fixing device according to claim 1, wherein the switching mechanism is switched to the second pressing state when the recording medium is an envelop-shaped recording medium.

8. An image forming apparatus comprising:

an imaging forming device that forms an unfixed image and transfers the unfixed image onto a recording medium, and a fixing device according to claim 1, which fixes the unfixed image transferred from the imaging device onto the recording medium.

9. A fixing device comprising:

a heating rotating body that is heated by a heater and rotates about a first rotation shaft;

a pressurizing rotating body that is in contact with a surface portion of the heating rotating body extending along a direction of the first rotation shaft and rotates about a second rotation shaft, and that forms a fixing portion through which a recording medium carrying an unfixed image is passed;

a pressing mechanism that presses the pressurizing rotating body against the heating rotating body and that uses a plurality of springs disposed on both end portions of the pressurizing rotating body in a direction of the second rotation shaft; and a switching mechanism that switches between a first pressing state in which the plurality of springs in the pressing mechanism are maintained so that a pressure of the plurality of springs is exerted in a state which the spring constants thereof are connected in parallel and a second pressing state in which the plurality of springs are maintained so that a pressure of the plurality of springs is exerted in a state which the spring constants thereof are connected in series.

10. The fixing device according to claim 9, wherein the pressing mechanism includes a pair of first rocking support members that supports both end portions of the pressurizing rotating body and rocks so as to become close to and away from the pressurizing rotating body while a part of each of the first rocking support members on a recording medium introduction side of the fixing portion is attached on a stationary support member via a first shaft, and the plurality of springs that are attached side by side so as to press a region of each of the first rocking support members on a rocking free end thereof so that each of the first rocking support members are rocked to be close to the heating rotating body, and the switching mechanism includes a compression changing mechanism that maintains all of the plurality of springs in a first compression state in which all of the plurality of springs are compressed by a predetermined compression amount when the switching mechanism is set to the first pressing state, and that maintains all of the plurality of springs in a second compression state in which all of the plurality of springs are compressed by a compression amount smaller than that in the first compression state when the switching mechanism is set to the second pressing state.

11. The fixing device according to claim 10, wherein the switching mechanism switches among the first to third pressing states, the switching mechanism includes a rocking and maintaining mechanism that rocks each of the first rocking support members so that all of the plurality of springs are set to the first compression state when the switching mechanism is set to the first pressing state, and all of the plurality of springs are set to the second compression state when the switching mechanism is set to the second pressing state, and when the switching mechanism is set to the third pressing state, the switching mechanism rocks each of the first rocking support members of the pressing mechanism using the rocking and maintaining mechanism of the switching mechanism so that each of the first rocking support members abuts against the stationary support member to maintain that rocking of each of the first rocking support members to a side becoming close to the heating rotating body is stopped.

12. The fixing device according to claim 10, wherein the pressurizing rotating body includes:

an endless belt that is in contact with the surface portion of the heating rotating body extending along the first rotation shaft and rotates;

a pressing body that has an elastic pressing portion and a non-elastic pressing portion and that forms the fixing portion to press the endless belt against the surface portion of the heating rotating body from an inner circumferential face side of the endless belt; and a pressing support member that rotatably supports the endless belt and supports the pressing body, the fixing device further comprising:

a pair of second rocking support members that supports the pressing support members of the pressurizing rotating body and rocks while attached on the pair of first rocking support members of the pressing mechanism via a second shaft so that a portion of the pressing body, which is used to press the endless belt against the heating rotating body, is changed between the elastic pressing portion and the non-elastic pressing portion, wherein the compression changing mechanism of the switching mechanism has a compression adjusting member that is in contact with one end portions of the plurality of springs of the pressing mechanism and that displaces the plurality of springs in a direction of compression and in a direction of extension.

13. The fixing device according to claim 12, wherein the switching mechanism includes a rocking and maintaining mechanism that rocks each of the first rocking support members so that all of the plurality of springs are set to the first compression state when the switching mechanism is set to the first pressing state, and all of the plurality of springs are set to the second compression state when the switching mechanism is set to the second pressing state, the rocking and maintaining mechanism of the switching mechanism is rotatably attached on each of the first rocking support members of the pressing mechanism and disposed in a state of being in contact with each of the second rocking support members and rocking each of the second rocking support members in a direction of moving the pressing body to be close to the heating rotating body, and the rocking and maintaining mechanism includes cams that rocks and maintain the first rocking support members between a position of the first pressing state and a position of the second pressing state, and, at the same time, rock and maintain the second rocking support members to a position in which the portion of the pressing body is changed between the elastic pressing portion and the non-elastic pressing portion.

* * * * *